US007781028B2

(12) United States Patent
Kunitake et al.

(10) Patent No.: US 7,781,028 B2
(45) Date of Patent: Aug. 24, 2010

(54) THIN FILM MATERIALS OF AMORPHOUS METAL OXIDES

(75) Inventors: Toyoki Kunitake, Tokyo (JP); Izumi Ichinose, Tokyo (JP); Shigenori Fujikawa, Fujimi (JP); Jianguo Huang, Wako (JP)

(73) Assignee: Riken, Wako-shi (JP)

( * ) Notice: Subject to any disclaimer, the term of this patent is extended or adjusted under 35 U.S.C. 154(b) by 406 days.

(21) Appl. No.: 11/780,214

(22) Filed: Jul. 19, 2007

(65) Prior Publication Data

US 2008/0020509 A1 Jan. 24, 2008

Related U.S. Application Data

(63) Continuation of application No. 10/096,304, filed on Mar. 13, 2002, now abandoned.

(30) Foreign Application Priority Data

Mar. 13, 2001 (JP) ..... 2001-070873
Dec. 25, 2001 (JP) ..... 2001-392088

(51) Int. Cl.

| | |
|---|---|
| ***B05D 5/00*** | (2006.01) |
| ***B05D 7/04*** | (2006.01) |
| ***B05D 1/36*** | (2006.01) |
| ***B05D 1/38*** | (2006.01) |
| ***B05D 3/06*** | (2006.01) |
| ***B31D 3/00*** | (2006.01) |
| *B05D 5/12* | (2006.01) |
| *H05H 1/46* | (2006.01) |

(52) U.S. Cl. ..... 427/537; 427/539; 427/126.3; 427/203; 427/213.31; 427/213.36; 427/214; 427/222; 427/264; 264/423; 264/434; 264/44; 216/67; 216/56

(58) Field of Classification Search ..... None
See application file for complete search history.

(56) References Cited

U.S. PATENT DOCUMENTS

| | | | |
|---|---|---|---|
| 4,349,456 | A | 9/1982 | Sowman |
| 4,830,879 | A | 5/1989 | Debsikdar |
| 5,127,964 | A | 7/1992 | Hamakawa et al. |
| 5,192,613 | A | 3/1993 | Work, III et al. |

(Continued)

FOREIGN PATENT DOCUMENTS

EP 0913432 A1 6/1999

(Continued)

OTHER PUBLICATIONS

Fujikawa et al., "Surface Fabrication of Interconnected Hollow Spheres of nm-Thick Titania Shall", Chemistry Letters,The Chemical Society of Japan, 2002 (no month, but must be after Aug. 12), pp. 1134-1135.*

(Continued)

*Primary Examiner*—Marianne L Padgett
(74) *Attorney, Agent, or Firm*—Birch, Stewart, Kolasch & Birch, LLP

(57) ABSTRACT

Amorphous metal oxide thin film is produced by removing through oxygen plasma treatment the organic component from an organics/metal oxide composite thin film having thoroughly dispersed therein such organic component at molecular scale. This ensures production of amorphous metal oxide thin film with low density and excellent thickness precision.

13 Claims, 13 Drawing Sheets

U.S. PATENT DOCUMENTS

| | | | | |
|---|---|---|---|---|
| 5,376,307 | A | 12/1994 | Hagiwara et al. | |
| 5,510,156 | A * | 4/1996 | Zhao | 427/534 |
| 5,958,591 | A | 9/1999 | Budd | |
| 6,140,746 | A | 10/2000 | Miyashita et al. | |
| 6,194,818 | B1 | 2/2001 | Sumi et al. | |
| 6,346,174 | B1 | 2/2002 | Finley et al. | |
| 6,419,849 | B1 | 7/2002 | Qiu et al. | |
| 6,677,043 | B2 | 1/2004 | Kunitake et al. | |
| 6,913,825 | B2 * | 7/2005 | Ostafin et al. | 428/402 |
| 6,929,764 | B2 * | 8/2005 | Jiang et al. | 264/42 |
| 7,211,143 | B2 * | 5/2007 | Yang et al | 117/84 |
| 7,407,895 | B2 * | 8/2008 | Kunitake et al. | 438/785 |
| 7,572,400 | B2 * | 8/2009 | Fujikawa et al. | 264/220 |
| 2007/0160521 | A1 * | 7/2007 | Winkler et al. | 423/445 R |
| 2008/0248216 | A1 * | 10/2008 | Yeung et al. | 427/553 |

FOREIGN PATENT DOCUMENTS

| | | | |
|---|---|---|---|
| JP | 10-249985 | * | 9/1998 |
| JP | 11-183711 | | 7/1999 |
| JP | 2000-007306 | | 1/2000 |
| JP | 2000-327310 | | 11/2000 |
| WO | WO-99/47253 | | 9/1999 |

OTHER PUBLICATIONS

Li et al., "A High-Rate, High-Capacity, Nanostructured Sn-Based Anode Prepared Using Sol-Gel Template Synthesis", Journal of the Electrochemical Society, vol. 148 (2),2001 (no month), pp. A164-A170.*

Cuisin et al.,"Fabrication of three-dimensional photonic structures with sub micrometer resolution by x-ray topography", Journal Vacuums Science Technology B, vol. 18 (6), Nov./Dec. 2000, pp. 3505-3509.*

Izumi Ichinose et al., "Imprinting and Selective Binding of Di-and Tri-Peptides in Ultrathin Ti02-Gel Films in Aqueous Solutions", The Chemical Society of Japan, No. 1, Jan. 5, 2002, pp. 104-105.

Jianguo Huang et al., "Zirconia-Titania Nanofilm with Composition Gradient", Nano Letters, vol. 2, No. 6, 2002, pp. 669-673.

V. Hessel et al., "Low-temperature Plasma Treatment of Magnesium Stearate Langmuir-Blodgett Films", Thin Solid Films, vol. 286, pp. 241-251, 1996.

Ichinose, I. et al., "Wrapping Individual Chains of Viologen Polymer with an Ultrathin Silicate Sheath", Advanced Materials, 2002, vol. 14, No. 5, pp. 344-346, Mar. 4, 2002.

Silicion Dioxide Definition, Semiconductor Glossary, Semiconductor OneSource, J. Ruzyllo, 2001, copyright 2001-2006.

Silicon Dioxide: Properties and Application, Enigmatic, Daniel M. Dobkin, no date, retrieved from Internet Nov. 21, 2006.

JP-10249985, no JP document, Kunitake et al., English abstract only, Sep. 22, 1989.

* cited by examiner

THIN FILM MATERIALS OF AMORPHOUS METAL OXIDES

This application is a Continuation of application Ser. No. 10/096,304, filed on Mar. 13, 2002, now abandoned, and for which priority is claimed under 35 U.S.C. §120; and this application claims priority of Japanese Application Nos. 2001-392088 filed on Dec. 25, 2001, and 2001-070873 filed on Mar. 13, 2001 under 35 U.S.C. §119, the entire contents of all are hereby incorporated by reference.

TECHNICAL FIELD

The present invention relates to a thin film material of amorphous metal oxide having low density and excellent thickness precision, and more specifically to low-density amorphous metal oxide thin film having nanometer-level thickness, which is produced by a novel method whereby an organics/metal oxide composite thin film having thoroughly dispersed therein an organic material and metal oxide in a molecular scale is first prepared, and the organic component is then removed therefrom by oxygen plasma treatment process.

RELATED ART

Metal oxide thin film having thickness controlled in nanometer-level precision has been expected for playing important roles in a wide variety of fields such as improvement in chemical, mechanical and optical properties, separation of gas or other materials, fabrication of various sensors, and production of high-density electronic devices. Demand for production of high-precision insulating thin film has already arisen in the next-generation integrated circuit technology based on a design rule of 10 to 20 nm, and similar demand has arisen also in the manufacture of high-density memory device and thin-film magnetic recording head.

Conventional production of metal oxide thin film has been relying upon spin-coating process or CVD process. On the other hand for the production of nano-film while controlling the thickness or composition of the oxide, it has been a practice to employ, besides the CVD process, double-ion-beam sputtering, one-step oxide film formation based on metal oxide deposition and oxygen plasma treatment of the surface thereof and low-energy ion implantation to oxide thin film. Such methods based on vacuum technologies are highly appreciated for their wide range of selection of pressure, substrate, temperature, or gas and target used as source materials, and are recognized as an important technology for attaining uniform film thickness. Only a few of such methods, however, can control the thickness in nanometer-level precision except for special cases such as growth of silicon oxide film on a high-purity silicon substrate. This is because metal oxides are generally not suitable for the CVD process, for they tend to produce micro-domain or crack. There is also reported an epitaxial growth technique of metal oxide, but the technique still remains unpractical since it only allows a narrow range of conditional settings.

Problems to be solved in the production of oxide thin films in nanometer-level precision relate to improvement in uniformity of the film thickness, thin film formation at lower temperature, production of precise thin film, improvement in adhesiveness to the substrate, improvement in the insulating property or establishment of super-low dielectric constant, and production of high-dielectric-constant thin films. In particular, thin film formation at lower temperature will be indispensable for producing molecular devices using organic materials, since heat-induced degradation of device characteristics in such ultra-fine processing is avoidable. The precise thin film is expectable in that achieving excellent super-low dielectric property, and will be grown to an important fundamental technology together with wiring technique in nanometer-level precision for the next-generation, highly-integrated circuit. While such situation have pushed ahead investigations for forming a porous thin film, such as zeolite film on solid substrate surfaces, the effort is still on the way to achievement of a desirable performance at present.

Various thin film formation methods based on the wet process have been proposed in order to produce oxide thin film under mild conditions. The methods include such as hydrolyzing a metal alkoxide at the gas/liquid boundary, transferring the resultant film onto a substrate which is followed by sintering; and such as subjecting a Langmuir-Blodgett film of metal salt of long-chain alkyl carboxylic acid or polysiloxane coated film to oxygen plasma treatment. These methods however often require calcination in order to obtain the oxide thin films, and involve operation of transferring the film from the gas/liquid boundary, which restricts species of the molecule or selection of the substrate well match to the purposes, and which makes it difficult to apply these methods to substrates having nano-scale irregularity.

As has been described above, none of the methods ever proposed is successful enough in producing a low-density amorphous metal oxide thin film with excellent thickness precision in a highly reproducible manner. The present invention aims at providing such thin film material.

SUMMARY OF THE INVENTION

In pursuit of attaining the foregoing object, the present inventors reached an idea of combining surface sol-gel process with oxygen plasma treatment.

The surface sol-gel process refers to a method in which a metal alkoxide compound is chemically adsorbed onto a solid substrate having hydroxyl groups on the surface thereof, and the adsorbed alkoxide is then hydrolyzed to thereby obtain an ultra-thin oxide film having molecular-level thickness. The hydroxyl groups newly generated by the hydrolysis of alkoxide groups on the outermost surface can be used for the next chemical adsorption of the metal alkoxide compound. So that repeating of such adsorption and hydrolysis can form a multi-layer metal oxide film in which each layer has nanometer-level thickness. The surface sol-gel process is applicable to the production of organic/metal oxide composite thin films. For example, alternative surface adsorption of organic molecules having hydroxyl groups and metal alkoxide compounds can produce a nano-thickness composite multi-layer film. In another possible process for producing such organics/metal oxide composite thin film, the organic molecule having active hydroxyl group is preliminarily reacted with the metal alkoxide compound to thereby produce a composite of the both, and the resultant composite is successively adsorbed onto the substrate surface by the surface sol-gel process. Such production method of the organics/metal oxide composite thin film based on the surface sol-gel process can successfully produce the composite thin film onto the surface of every kind of materials including inorganic, organic, metal and polymer ones having functional groups, such as hydroxyl group and carboxyl group having reactivity to the metal alkoxide. Another advantage of the method resides in that the film formation is based on adsorption in the liquid phase, which ensures formation of a uniform composite thin film independent of the substrate morphology. There is still another advantage that properly selecting species of the metal alkoxide to be adsorbed, species of the organic compound or order of the adsorption can control the compositional distribution of the metal oxide and organic compound within the composite thin film at nanometer level.

The present inventors had an idea that a dense and low-density amorphous metal oxide thin film should successfully be produced by a method by which the organic component in the organics/metal oxide composite thin film is removed typically by oxygen plasma treatment. The present inventors finally found out that desired thin film material of amorphous metal oxide can be obtained by removing, through oxygen plasma treatment, the organic component from the organics/metal oxide composite thin film in which such organic component is thoroughly dispersed in a molecular scale, which led us to propose the present invention.

That is, the present invention is to provide a thin film material of amorphous metal oxide having a structure which is obtainable by forming an organics/metal oxide composite thin film having dispersed therein an organic component in a molecular scale and removing the organic component. The organic component can be preferably removed by oxygen plasma treatment. The density of the thin film material of amorphous metal oxide of the present invention is preferably 0.5 to 3.0 g/cm$^3$, more preferably 0.8 to 2.5 g/cm$^3$, and the thickness thereof is preferably 0.5 to 100 nm. The thin film material of the present invention is preferably produced from the organics/metal oxide composite thin film having thickness of 0.5 to 50 nm and a content of the organic component of 15 to 85 wt %.

Such amorphous metal oxide thin film can be formed on a substrate such as solid or fine particle. Forming of the amorphous metal oxide thin film onto a substrate having on the surface thereof an intentionally designed irregularity results in the film having a profile conforming to such design. Such material comprising a substrate and a thin film formed on the surface thereof can be produced by forming, through chemical adsorption and rinsing, on the surface of such substrate the organics/metal oxide composite thin film having dispersed therein such organic component in molecular scale, and then by removing such organic component through oxygen plasma treatment to thereby produce the thin film material of amorphous metal oxide. Using now an organic nanoparticle as the substrate and removing such organic nanoparticle by oxygen plasma treatment can also provide the thin film material of amorphous metal oxide in a hollow form.

The present invention is also to provide a material which is produced by bringing a compound having metal alkoxide group into contact with the substrate having on the surface thereof groups reactive with such metal alkoxide group to thereby allow such compound having a metal alkoxide group to chemically adsorb on the surface of such substrate; removing through rinsing the excessive portion of such compound having a metal alkoxide group; hydrolyzing such compound having a metal alkoxide group remaining on the surface of the substrate to thereby form a metal oxide thin film; optionally repeating the process for forming another metal oxide thin film on the previously-formed metal oxide thin film at least once or more number of times; allowing the outermost metal oxide thin film to contact with an organic compound capable of chemically adsorbing onto such metal oxide thin film and of forming reactive groups having reactivity with the metal alkoxide group; removing the excessive portion of such organic compound to thereby form an organic component thin film; optionally repeating the process for forming another metal oxide thin film on the previously-formed organic compound thin film at least once or more number of times; and removing the organic component through oxygen plasma treatment (referred to as "method A", hereinafter).

The present invention is also to provide a material which is produced by bringing a compound having metal alkoxide group into contact with the substrate having on the surface thereof groups reactive with such metal alkoxide group to thereby allow such compound having metal alkoxide group to chemically adsorb on the surface of such substrate; removing through rinsing the excessive portion of such compound having metal alkoxide group; hydrolyzing such compound having metal alkoxide group remaining on the surface of the substrate to thereby form a metal oxide thin film; optionally repeating the process for forming another metal oxide thin film on the previously-formed metal oxide thin film at least once or more number of times; allowing the outermost metal oxide thin film to contact with an organic compound capable of chemically adsorbing onto such metal oxide thin film and of forming reactive groups having reactivity with the metal alkoxide group; removing the excessive portion of such organic compound to thereby form an organic component thin film; repeating the process for forming such metal oxide thin film and such organic compound thin film at least once or more number of times; optionally repeating the process for forming another metal oxide thin film on the previously-formed organic compound thin film at least once or more number of times; and removing the organic component through oxygen plasma treatment. In the production process for such thin film material, it is also allowable to compose at least one of the metal oxide thin film and organic compound thin film with those different from the residual metal oxide thin film and organic compound thin film; and to remove the organic component through oxygen plasma treatment.

The present invention is still also to provide a material which is produced by forming an organics/metal alkoxide composite comprising compound having metal alkoxide group and an organic compound having hydroxyl group or a group capable of binding with such metal alkoxide group; bringing the organics/metal alkoxide composite into contact with the substrate having on the surface thereof groups reactive with such metal alkoxide group to thereby allow such composite to chemically adsorb on the surface of such substrate; removing through rinsing the excessive portion of such organics/metal alkoxide composite; hydrolyzing such organics/metal alkoxide composite remaining on the surface of the substrate to thereby form an organics/metal oxide composite thin film; optionally repeating the process for forming another organics/metal oxide composite thin film at least once or more number of times; and removing the organic component through oxygen plasma treatment (referred to as "method B" hereinafter).

The reactive group having reactivity to the metal alkoxide group or the group capable of binding with metal alkoxide group can be exemplified by hydroxyl group and carboxyl group.

DETAILED DESCRIPTION OF THE INVENTION

Figure 1:
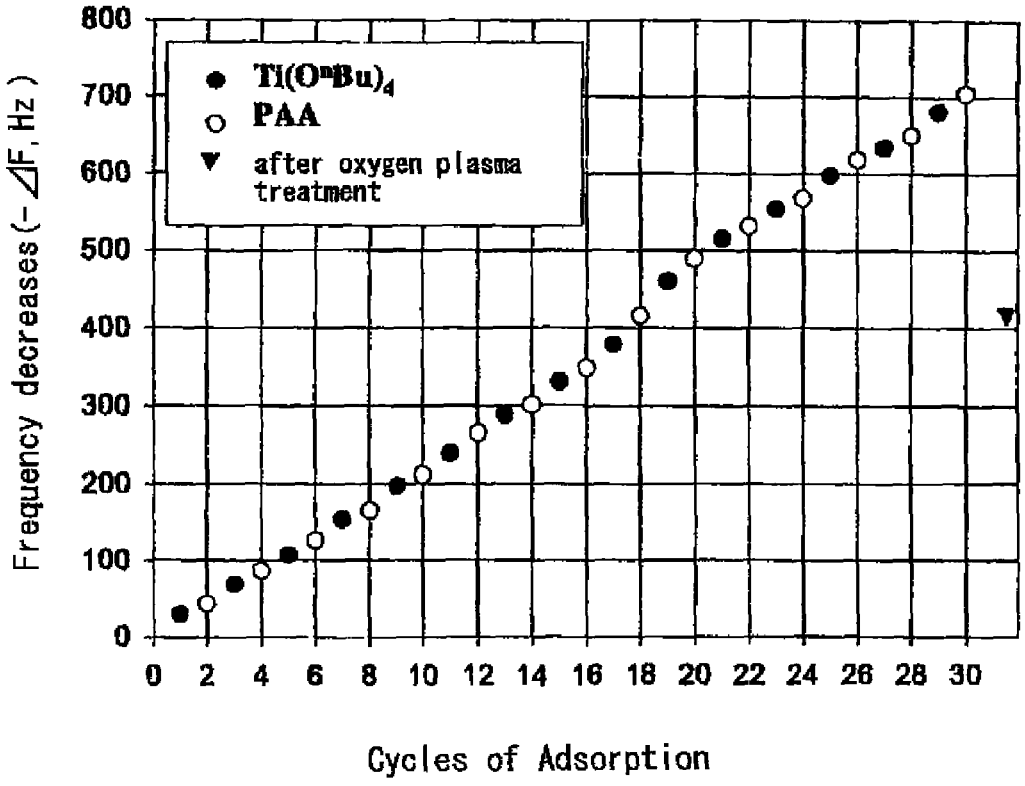
FIG. 1 is a graph showing changes in frequency of a quartz crystal microbalance resonator caused by stacking and oxygen plasma treatment of the organics/metal oxide composite thin film of Example 1.

The thin film material of amorphous metal oxide of the present invention will be explained below. It should now be noted that, in this specification, any notation for numerical range using a word "to" indicates a range defined by values placed before and after "to", where both ends are inclusive as minimum and maximum values.

The thin film material of amorphous metal oxide of the present invention as described from one aspect is such that having a structure derived from an organic/metal oxide composite thin film having previously dispersed therein an organic component in a molecular scale, from which a portion corresponded to such organic component is already removed. "A structure from which a portion corresponded to such organic component is already removed" in the context herein means a structure having voids in the organic/metal oxide composite thin film so as to correspond with a spatial location of organic component domains previously existed therein. The structure includes such that having the voids exactly in the place previously occupied by the organic component of the organics/metal oxide composite thin film; such that having the voids in and around the place previously occupied by the organic component of the organics/metal oxide composite thin film; and such that having the voids in or around the place previously occupied by the organic component of the organics/metal oxide composite thin film and a part of such voids communicate with each other to form a network structure.

The thin film material of amorphous metal oxide of the present invention as described from another aspect is such that being produced by removing through oxygen plasma treatment the organic component from the organics/metal oxide composite thin film having thoroughly dispersed therein such organic component in a molecular scale.

The thin film material of the present invention is preferably formed onto a substrate surface. Species of the substrate are not specifically limited so far as they can allow the thin film to be formed thereon. Considering that the thin film material of the present invention is preferably produced using a compound having metal alkoxide group, the substrate is preferably such that having a group reactive with such metal alkoxide group. The group reactive to the metal alkoxide group is preferably hydroxyl group or carboxyl group. Materials for composing the substrate are not specifically limited, where available examples thereof include various materials composed of organic substance, inorganic substance and metals. Typical examples include substrates comprising an inorganic substance such as glass, titanium oxide or silica gel, substrates comprising an organic substance such as polyacrylic acid, polyvinyl alcohol, cellulose or phenol resin, and metal having the surface labile to oxidation such as iron, aluminum and silicon.

For the case that the thin film material of the present invention is formed on a substrate having on the surface thereof no reactive group (e.g., cadmium sulfide, polyaniline, gold), it is recommendable to preliminarily introduce hydroxyl group or carboxyl group onto the surface of such substrate. Any known methods for introducing hydroxyl group may be employed without limitation. For example, the surface of gold can have hydroxyl group by being adsorbed with mercaptoethanol or the like. The surface of substrate having cationic charge can have carboxyl group by being adsorbed with an anionic polymer electrolyte, such as polyacrylic acid, so as to form an extremely thin layer.

The amount of hydroxyl group or carboxyl group residing on the surface of the substrate affects the density of the organic/metal oxide composite thin film to be formed. So that the amount of the reactive group (in particular hydroxyl group or carboxyl group) resides on the substrate surface is preferably within a range from $5.0\times10^{13}$ to $5.0\times10^{14}$ equivalent/cm$^2$ in general, and more preferably from $1.0\times10^{14}$ to $2.0\times10^{14}$ equivalent/cm$^2$.

There is no specific limitation on the shape and surface profile of the substrate. More specifically, since the present invention is based on the process by which the organics/metal oxide composite thin film is formed by chemical adsorption from a liquid phase and rinsing, the substrate need not have a smooth surface. So that the thin film material of the present invention can be formed on every kind of solid surface having a form of fiber, bead, powder or flake, or on the inner wall of tube, inner surface of filter or other porous material, and other larger surfaces. In particular, the thin film material of the present invention can be formed also on a substrate having on the surface thereof irregularity produced by lithographic process; a substrate having aligned thereon organic or inorganic nanoparticles in a two-dimensional manner; organic ultrathin film; and a substrate having aligned thereon biological molecules such as tobacco mosaic virus in a two-dimensional manner. The thin film material of the present invention can be formed still also on a metal oxide thin film produced typically by the surface sol-gel process, although being not limited to such process.

Methods for forming the organics/metal oxide composite thin film on the solid surface are not specifically limited, where preferable methods can be exemplified by the foregoing methods A and B.

Any known compound having metal alkoxide group can be used in the methods A and B without special limitation. Typical examples of such compound include metal alkoxide compounds such as titanium butoxide ($Ti(O^nBu)_4$), zirconium propoxide ($Zr(O^nPr)_4$), aluminum butoxide ($Al(O^nBu)_4$), niobium butoxide ($Nb(O^nBu)_5$), and tetramethoxysilane ($Si(OMe)_4$); metal alkoxides having two or more alkoxide groups within one molecule such as methyltrimethoxysilane ($MeSi(OMe)_3$) and diethyldiethoxysilane ($Et_2Si(OEt)_2$); and metal alkoxides such as double alkoxide compounds like $BaTi(OR)_x$.

It is also allowable in the present invention to use, besides the foregoing metal alkoxide compounds, alkoxide gel particle obtained by adding a small amount of water to such metal alkoxide to thereby partially hydrolyze and condense it; double-cored or clustered alkoxide compound having a plural number or plural kinds of metals; or polymer derived from metal alkoxide compounds linearly crosslinked with each other via oxygen atoms. It is also allowable to combine two or more of these compounds having metal alkoxide group as occasions demand.

"The organic compound capable of chemically adsorbing onto such metal oxide thin film and of forming reactive groups having a reactivity with the metal alkoxide group" used in method A refers to a compound capable of binding onto the surface of the metal oxide thin film through chemical bond such as coordinate bond or covalent bond, and of keeping such tight bond with the metal oxide thin film even in the succeeding rinsing. While the compounds well match to the purpose are not specifically limited, those having a plurality of hydroxyl groups or carboxyl groups in a single molecule are preferably used. Specific examples thereof include polymer compounds such as polyacrylic acid, polyvinyl alcohol, polymethacrylic acid, polyglutamic acid and starch; monosaccharides such as glucose and mannose; and disaccharide. Of course, low-molecular-weight compounds having a plurality of hydroxyl groups, such as dye, are also preferably used.

"The organic compound having a hydroxyl group or a group capable of binding with such metal alkoxide group" used in method B refers to a compound capable of binding with a metal alkoxide group or with a hydroxyl group generated by hydrolysis of such metal alkoxide group through coordinate bond or covalent bond. While the compounds well match to the purpose are not specifically limited, those having metal alkoxide group, carboxyl group or hydroxyl group are preferably used. Specific examples thereof include organosilane compounds having alkoxide groups such as phenyltrimethoxysilane; organic compounds having carboxyl group such as benzoic acid; monosaccharides such as glucose or mannose; and disaccharide.

In method B, the foregoing "organic compound having a hydroxyl group or a group capable of binding with such metal alkoxide group" is reacted with the "compound having metal alkoxide group" to thereby produce "organics/metal alkoxide composite", and which composite is then adsorbed onto the solid surface. While methods for producing the composite in method B is not specifically limited, generally acceptable method is such that mixing the "organic compound having a hydroxyl group or a group capable of binding with such metal alkoxide group" and "compound having metal alkoxide group" in an organic solvent. It is also allowable to optionally add a small amount of water to thereby produce such composite.

In methods A and B, these materials are chemically adsorbed onto the substrate surface. First, the compound having metal alkoxide group or the organics/metal alkoxide composite compound is brought into contact with the substrate surface having groups reactive to the metal alkoxide group, to thereby allow such compound having metal alkoxide group to chemically adsorb onto the substrate surface. The contact between the compound having metal alkoxide group and the substrate can be attained by a method based on saturation adsorption onto the substrate surface without any limitation. This is preferably attained in general by dipping the substrate into an organic solvent solution dissolved with the compound having metal alkoxide group, or by coating such solution onto the substrate surface typically by the spin-coating process. The solvents available herein are not specifically limited, methanol, ethanol, toluene, propanol, benzene or the like can be used independently or in combination. It is to be noted that the organics/metal alkoxide composite compound in method B can be produced within such solvents.

Concentration of the compound having metal alkoxide group in the solution is preferably 1 to 100 mM or around. Concentration of the organics/metal alkoxide composite is again preferably 1 to 100 mM or around on the basis of concentration of the compound having metal alkoxide group used for the compounding, and 0.01 to 50 mM or around on the bases of concentration of the "organic compound having a hydroxyl group or a group capable of binding with metal alkoxide group". Time duration and temperature for the contact differ depending on activity of the compound having metal alkoxide group employed in the process and cannot simply be described, but can generally be determined within a range from one minute to several hours, and 0 to 100° C. Significant reduction in the process time can also be expected by using catalyst such as acid or base in the chemical reaction.

By such contact operation, the substrate will have on the surface thereof the compound having metal alkoxide group or organics/metal alkoxide composite which is adsorbed so as to saturate the hydroxyl group or carboxyl group on the substrate surface, and also will have such compound having metal alkoxide group or organics/metal alkoxide composite through physical adsorption. To obtain a homogeneous and uniform thin film, it may sometimes be necessary to remove the excessive portion of the compound having metal alkoxide group or organics/metal alkoxide composite.

Methods for removing the excessive portion of the compound having metal alkoxide group or organics/metal alkoxide composite are not specifically limited so far as they can selectively remove such compound. One preferable method relates to cleaning using the foregoing organic solvent. The rinsing can preferably be effected by a dipping method into the organic solvent, spray cleaning, or vapor cleaning. Cleaning can preferably be carried out at a temperature same as that for the contact process described in the above.

In methods A and B, the removal by cleaning is followed by the hydrolysis. By the hydrolysis, the compound having metal alkoxide group or organics/metal alkoxide composite condenses, to hereby produce the metal oxide thin film or organics/metal oxide composite thin film.

Any known methods for the hydrolysis are applicable without limitation, where most general method relates to dipping into water of the substrate having adsorbed thereon the compound having metal alkoxide group or organics/metal alkoxide composite. The water is preferably ion-exchanged water in view of preventing contamination and producing a high-purity metal oxide. Significant reduction in the process time can also be expected by using catalyst such as acid or base in the hydrolysis. The hydrolysis can also be proceeded by dipping the substrate having adsorbed thereon the compound having metal alkoxide group or organics/metal alkoxide composite into an organic solvent containing a small amount of water. For the metal alkoxides that are highly reactive with water, hydrolysis can be done by reacting with vapor in the air.

After the hydrolysis, the surface of the substrate is optionally dried with drying gas such as nitrogen, which yields the metal oxide thin film or organics/metal oxide composite thin film.

In method B, the film thickness of the organics/metal oxide composite thin film can be controlled on nanometer level by repeating a series of such operations once or more number of times. More specifically, the control of the film thickness of the organics/metal oxide composite thin film in method B can be attained by repeating the contact of the organics/metal alkoxide composite to thereby effect chemical adsorption thereof with the aid of hydroxyl groups reside on the outermost thin film formed by the hydrolysis, followed by removal of the excessive portion of such adsorbed component, and hydrolysis.

In method A, metal oxide thin film formed on the substrate surface is further subjected to chemical adsorption with "the organic compound capable of chemically adsorbing onto such metal oxide thin film and of forming reactive groups having reactivity with the metal alkoxide group" (referred to as an "adsorption-active organic compound", hereinafter). First, the contact of the substrate having on the surface thereof the metal oxide thin film with the adsorption-active organic compound can be attained, without any limitation, by a method of allowing such compound to adsorb onto the substrate surface in a saturated manner. This is preferably attained in general by dipping the substrate into an organic solvent solution dissolved with the adsorption-active organic compound, or by coating such solution onto the solid surface typically by the spin-coating process. The solvents available herein are not specifically limited, and methanol, ethanol, toluene, propanol, benzene or the like can be used independently or in combination.

Concentration of the adsorption-active organic compound in the solution is preferably 1 to 100 mM or around. Time duration and temperature for the contact differ depending on activity of the compound having metal alkoxide group employed in the process and cannot simply be described, but can generally be determined within a range from one minute to several hours, and 0 to 100° C. Significant reduction in the process time can also be expected by using catalyst such as acid or base in the chemical reaction. By such contact operation, the substrate will have on the outermost surface thereof the adsorption-active organic compound which is adsorbed in a saturation amount, and such adsorption-active organic compound adsorbed through physical adsorption. To obtain a homogeneous and uniform thin film, it may sometimes be necessary to remove the excessive portion of the adsorption-active organic compound. Methods for removing the excessive portion of the adsorption-active organic compound are not specifically limited so far as they can selectively remove such compound. One preferable method relates to cleaning using an organic solvent. The cleaning can preferably be effected by a dipping method into the organic solvent, spray cleaning, or vapor cleaning. The cleaning can preferably be carried out at a temperature same as that for the contact process described in the above.

In method A, such operation results in formation of a thin film of the adsorption-active organic compound on the substrate surface. The thin film of the adsorption-active organic compound has on the surface thereof reactive group which are reactive to metal alkoxide, and can again adsorb the foregoing compound having metal alkoxide group. By forming the metal oxide thin film on the surface of the thin film of the adsorption-active organic compound according to the foregoing process, the organics/metal oxide composite thin film of method A is produced. In method A, repeating the process of forming the metal oxide thin film and the process of forming the thin film of the adsorption-active organic compound at least once or more number of times ensures control of the thickness of the organics/metal oxide composite thin film on nanometer level.

In the process of preparing the thin film material of the present invention, there is no special limitation on the number of times that the organics/metal oxide composite thin film is formed or the order of the formation processes. In typical cases, the organics/metal oxide composite thin film can be formed by method A or method B after the formation of the metal oxide thin film was repeated once or more number of times. It is also allowable to combine methods A and B to thereby form the organics/metal oxide composite thin film.

By removing the organic component from thus-obtained organics/metal oxide composite thin film through oxygen plasma treatment, the thin film material of amorphous metal oxide of the present invention is successfully obtained. It is now also allowable to preliminarily remove the organic component to a certain extent in a preliminarily process before the oxygen plasma treatment.

Time duration and temperature of the oxygen plasma etching process affect the organic component content and density of the thin film material of amorphous metal oxide to be produced. The time duration necessary for the removal of the organic component may differ depending on the composition or thickness of the organics/metal oxide composite thin film that formed, or on the chemical structure of the organic component employed, so that it cannot simply be specified. The temperature can generally be defined within a range from 0 to 200° C., and the time duration within a range from one minute to ten hours. Partial pressure of oxygen in the oxygen plasma treatment preferably resides in a range from 150 to 200 mTorr, and RF power in such oxygen plasma treatment preferably resides in a range from 5 to 40 W. Details for such oxygen plasma treatment can be referred to Examples shown below.

By such process, the organic component can be successfully removed from the organics/metal oxide composite thin film, to thereby yield the thin film material of amorphous metal oxide according to the present invention. While not adhering to any theories, it is supposed that the formation of such amorphous metal oxide thin film is based on the principle below.

In the present invention, the organics/metal oxide composite thin film is formed on the substrate surface by chemical absorption from the solution and the succeeding rinsing. Thickness of the ultra-thin film formed by such chemical absorption generally resides in a range from 0.5 to 10 nm, and from 0.5 to 2 nm for most cases. For example, the thickness of the composite thin film in Example 1 based on method A, described later, is 0.66 nm. The organic component domain in such thinned film structure never exceeds the thickness of each composite thin film formed in each adsorption cycle. More specifically, the thickness of the organic component domain generally resides in a range from 0.5 to 10 nm, and from 0.5 to 2 nm for most cases.

Expansion range of the organic compound domain within the composite thin film can vary depending on the molecular structure of such organic component, where a variable range thereof resides in a range from 0.5 to 100 nm even when the molecule is relatively large, and generally in a range from 0.5 to 10 nm for most cases. So that, the organic component domain in such composite thin film extends over a portion having a thickness of 0.5 to 2 nm and a diameter of 0.5 to 10 nm in most cases. Shape of such domain may be dot having a size equivalent to a single molecule, string having a diameter equivalent to a single molecule, or plate having a thickness equivalent to a single molecule, where the volume thereof never exceeds the foregoing range.

That is, the thickness of the organic component domain within the organics/metal oxide composite thin film in the present invention never exceeds the molecular thickness (0.5 to 10 nm in general), and the expansion range thereof never exceeds the molecular size (0.5 to 100 nm in general). The term "organic component dispersed in a molecular scale" is used in such context in this specification.

In the present invention, the organics/metal oxide composite thin film is provided in a molecular thickness or provided as a stacked material composed thereof having a molecular thickness. Since each of the metal oxide layer in the composite thin film is formed after the hydrolysis, a network of the metal oxide based on covalent bonds is constructed. Such network structure based on covalent bonds allows activated oxygen molecule (mainly oxygen ion and oxygen radical) having a size of several angstroms to pass through such structure during the oxygen plasma treatment. The network structure per se, which is fully developed with the covalent bonds, is however stable against activated oxygen. So that such covalent bond network of the metal oxide is retained even after the organic component is removed. That is, the metal oxide layer has a self-supporting property. The self-supporting property of the metal oxide layer will be proved in Examples described later.

Texture structure of the amorphous metal oxide thin film produced in the present invention is determined by the status of complexation between the organic component and metal oxide in the precursory organics/metal oxide composite thin film. The present invention is successful in obtaining the organics/metal oxide composite thin film having a uniform thickness and entire homogeneity without causing compositional localization, and in which the organic component is dispersed in a molecular scale, so that the amorphous metal oxide thin film derived therefrom can also have a uniform thickness and entire homogeneity without causing compositional localization. Content of the organic component in the organics/metal oxide composite thin film can be controlled within a range from 15 to 85%, so that the density of the amorphous metal oxide thin film will be controllable within a range from 0.5~3.0 g/cm$^3$.

Features of the present invention will further be detailed below referring to specific Examples. Starting compounds, amount of use thereof, ratio of use, operations, procedures or the like can properly be modified without departing from the spirit of the present invention. Thus it is to be understood that the present invention is by no means limited to the specific examples explained below.

In Examples described below, in order to prove that the organics/metal oxide composite thin film is successively stacked in a constant amount, such organics/metal oxide composite thin film was experimentally formed on a quartz crystal microbalance resonator and increase in the mass of the thin film was estimated based on changes in the frequency of such quartz crystal microbalance resonator. Removed amount of the organic component by the oxygen plasma treatment was also estimated based on changes in the frequency of the quartz crystal microbalance resonator. The quartz crystal microbalance resonator is a device which can weigh a thin film formed on its electrode based on changes in the frequency to a precision of $10^{-9}$ g.

The quartz crystal microbalance resonator was such that having gold electrodes, which was cleaned using Pirana solution (a 3:1 mixed solution of 96% sulfuric acid and 30% hydrogen peroxide), thoroughly washed with pure water, immersed in a 10 mM ethanol solution of mercaptoethanol for 12 hours to thereby introduce hydroxyl groups on the surface of the electrode, then washed with ethanol, and blown with nitrogen gas to be thereby thoroughly dried before use.

Status of removal of the organic component during the oxygen plasma treatment was evaluated based on infrared spectrometry. The infrared spectrometry employed a mica substrate, on the surface of which the organics/metal oxide composite thin film was formed. On the other hand a quartz substrate was used in UV-visible absorption spectrometry.

Example 1

An organics/metal oxide composite thin film was produced according to method A in Example 1.

Titanium butoxide ($Ti(O^nBu)_4$) was dissolved in 1:1 (v/v) mixed solvent of toluene and ethanol so as to attain the concentration of 100 mM, the foregoing quartz crystal microbalance resonator was dipped in the obtained solution at 25° C. for 3 minutes, washed by rinsing the quartz crystal microbalance resonator in ethanol at 25° C. for 1 minute, dipped in an ion-exchanged water at 25° C. for 1 minute to thereby form thereon a metal oxide thin film, and blown with nitrogen gas for drying. After the frequency of such quartz crystal microbalance resonator was measured, the resonator was dipped in polyacrylic acid (abbreviated as PAA, hereinafter) ethanol solution in the concentration of 1 mg/ml for 10 minutes, washed by dipping into ethanol at 25° C. for 1 minute, and blown with nitrogen gas for drying. The frequency of the quartz microbalance resonator was measured again. Such thin film forming processes were repeated to thereby form the organics/metal oxide composite thin film. The quartz microbalance resonator having formed on the surface thereof the organics/metal oxide composite thin film was then placed in a sample chamber of an oxygen plasma generation apparatus, and etched by oxygen plasma under an oxygen partial pressure of 176 mTorr and an RF power of 10 W at room temperature for 20 minutes. Oxygen plasma etching was further carried out with an oxygen partial pressure of 176 mTorr and an RF power of 20 W at room temperature for 40 minutes.

FIG. 1 is a graph showing changes in the frequency of a quartz microbalance resonator caused by stacking of the organics/metal oxide composite thin film and by oxygen plasma treatment, where ($-\Delta F$] represents decrease in the frequency from that for the resonator before the organics/metal oxide composite thin film is formed thereon.

As is known from FIG. 1, the frequency decreased in proportion to the number of stacking of the organics/metal oxide composite thin films. This result indicates that the organics/metal oxide composite thin films having a constant mass are successively formed on the surface of the electrode of the quartz microbalance. The total film thickness was estimated as 10 nm based on such changes in the frequency after 15 cycles ($-\Delta F=705.1$). Increase in the film thickness in each cycle was thus calculated as 6.6 Å. Total decrease in the frequency caused by the adsorption of titanium butoxide (denoted as $Ti(O^nBu)_4$ in FIG. 1) was estimated as 412.5 Hz, and such total decrease caused by the adsorption of PAA was estimated as 292.6 Hz. Oxygen plasma treatment resulted in increase in the frequency by 299.5 Hz. This value is almost equivalent to the total decrease in the frequency caused by the adsorption of PAA, which indicates that the oxygen plasma treatment in the present Example completely removed the organic component.

Figure 2:
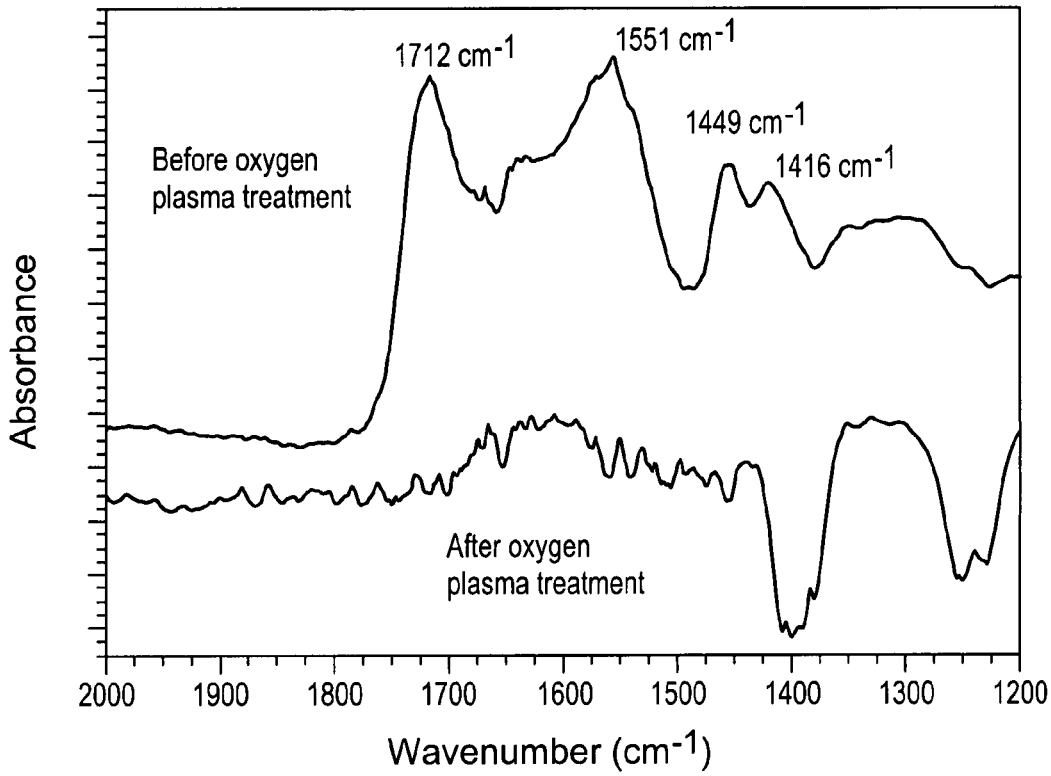
FIG. 2 is an infrared absorption spectral change of the organics/metal oxide composite thin film and amorphous metal oxide thin film of Example 1.

Infrared absorption spectrometry was carried out to confirm the formation of the organics/metal oxide composite thin film and the removal of the organic component according to this Example. A test sample was prepared using a mica plate, on the newly-cleft surface of which titanium butoxide and PAA were adsorbed in 5 cycles according to the foregoing operation. The sample was then treated with oxygen plasma under oxygen partial pressure of 176 mTorr and RF power of 10 W at room temperature for 10 minutes. Infrared absorption spectra obtained before and after the treatment are shown in FIG. 2.

Strong absorption peaks around 1,550 $cm^{-1}$ and 1,710 $cm^{-1}$ are attributable to C═O stretching vibration of carboxyl group of PAA coordinated to titanium atom, and of carboxyl group of PAA not coordinated to titanium atom, respectively. These absorption peaks clearly disappeared after the oxygen plasma treatment. It is thus obvious that the organic component was successfully removed from the organics/metal oxide composite thin film produced according to the method of the present Example.

UV-visible absorption spectrometry was then carried out to confirm that the amorphous metal oxide composite thin film remained on the solid surface after the removal of the organic component by the oxygen plasma treatment from the organics/metal oxide composite thin film. A test sample was prepared using a quartz plate, on the surface of which titanium butoxide and PAA were adsorbed for 5 cycles, to thereby produce the organics/metal oxide composite thin film. The sample was then treated by oxygen plasma under oxygen partial pressure of 176 mTorr and RF power of 10 W at room temperature for 10 minutes. UV-visible absorption spectra obtained before and after the treatment are shown in FIG. 3.

Figure 3:
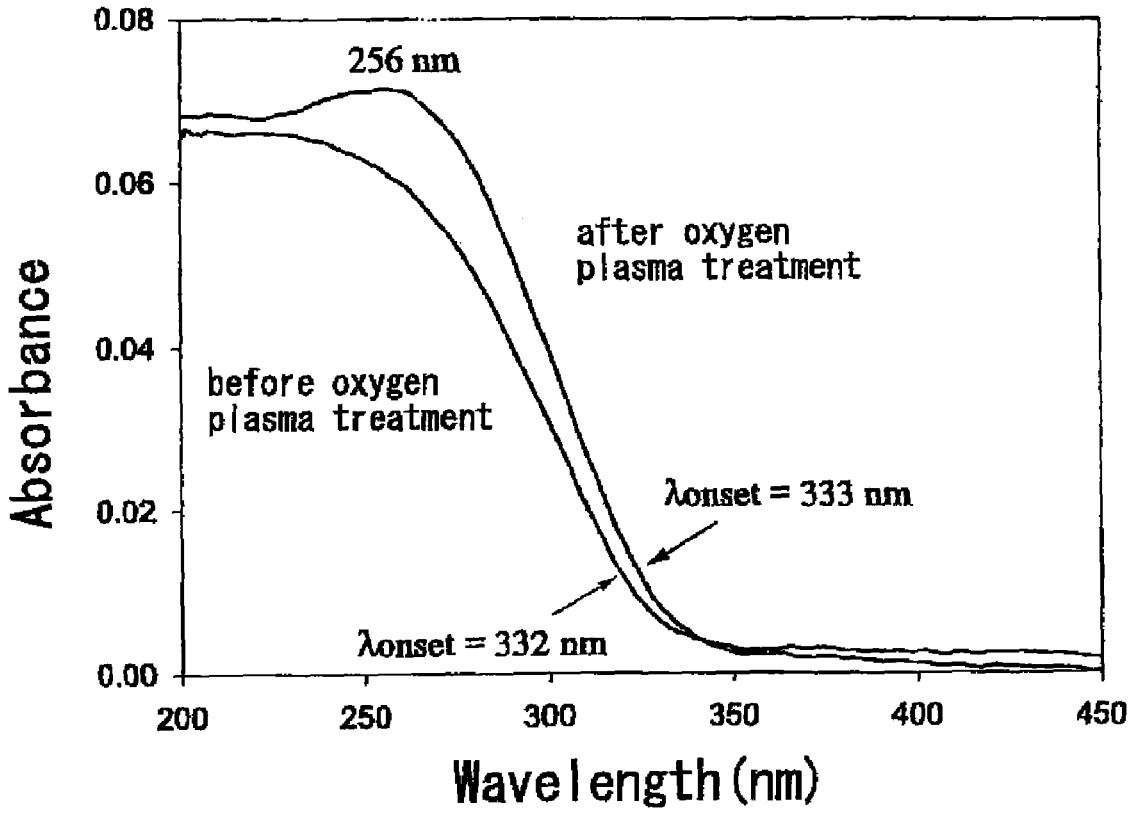
FIG. 3 is a UV-visible absorption spectral change of the organics/metal oxide composite thin film and amorphous metal oxide thin film of Example 1.

As shown in FIG. 3, the sample before the oxygen plasma treatment gave a spectrum having an absorption threshold at 332 nm. It is generally known that the absorption threshold of titanium oxide crystal appears at 413 nm for rutile type, and 387 nm for anatase type. The absorption spectra of the organics/metal oxide composite thin film produced in this Example shows absorption threshold markedly shifted towards shorter wavelength region than the absorption threshold of the bulk titanium oxide crystal. The result indicates that the titania ultra-thin film in the organics/metal oxide composite thin film does not have a well-developed crystal structure. The absorption spectrum of the sample after the oxygen plasma treatment gave the absorption threshold at 333 nm, and absorption maximum at around 256 nm. The fact that the absorption ascribable to the titania ultra-thin film was observable even after the oxygen plasma treatment indicates that the amorphous metal oxide thin film remained on the substrate surface by the procedures of this Example. Another fact that the absorption around 300 nm increased after the oxygen plasma treatment indicates that such oxygen plasma treatment promoted the condensation of oxygen atoms and titanium atoms within the titania ultra-thin film to thereby further develop the covalent bond network of such metal oxide. This, however, does not mean advanced crystallization of titania. It is already known from the previous reports that a rutile-type crystal of 5.5 nm diameter and an anatase-type grain of 2.4 nm diameter gave the absorption thresholds at 398 nm and 370 nm, respectively. The absorption thresholds of the thin film material produced in this Example was found to be shifted to a markedly shorter wavelength than those of such nanoparticles, which proves the formation of the amorphous titania ultra-thin film.

Figure 4:
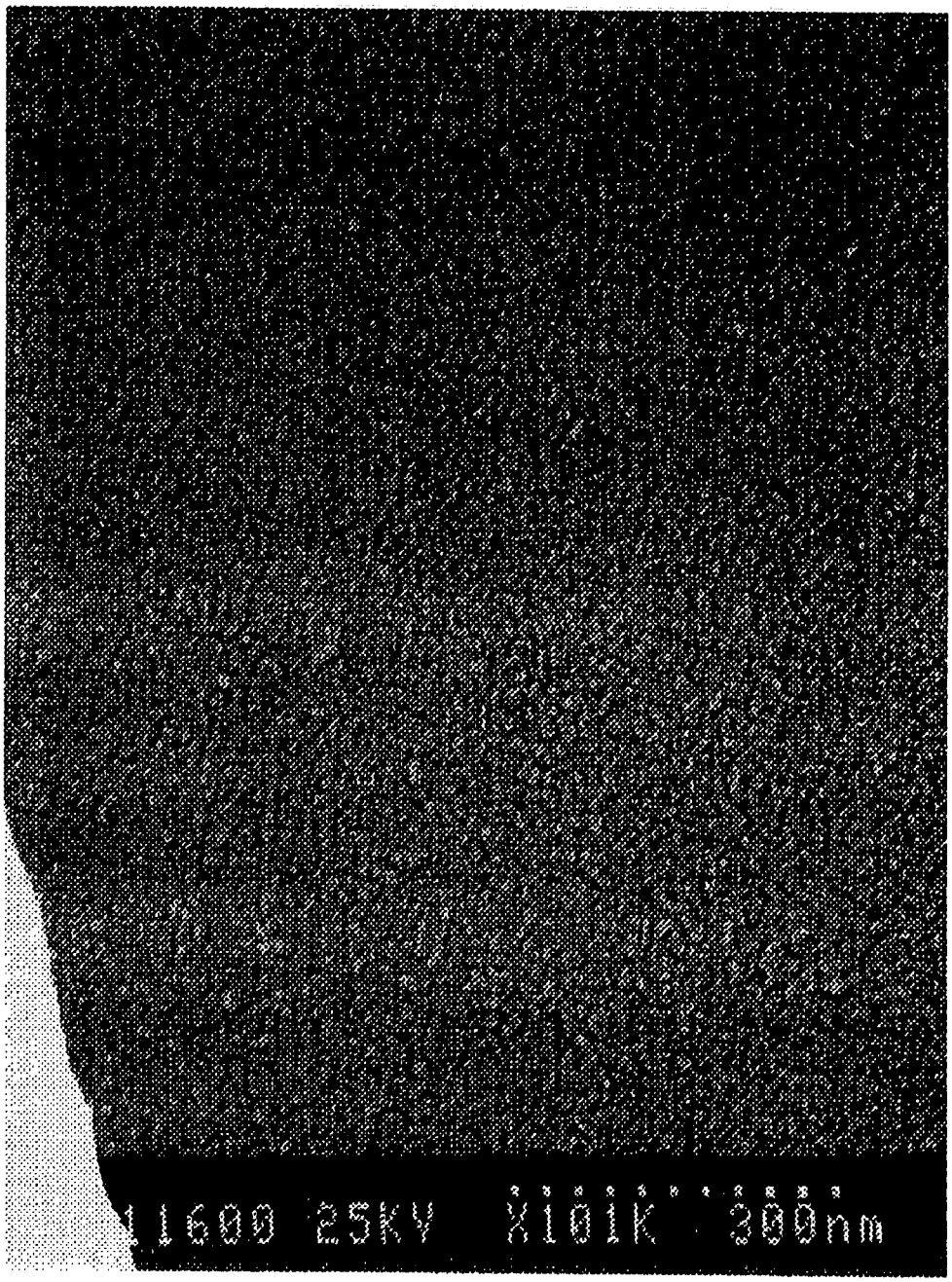
FIG. 4 is an image of the surface of amorphous metal oxide thin film of Example 1 observed with a scanning electron microscope.

To further confirm that a uniform amorphous metal oxide thin film can be formed on the surface of the substrate in this Example, the thin film was observed with a scanning electron microscope. A sample employed herein was prepared using a mica plate, on the newly-cleft surface of which titanium butoxide and PAA were adsorbed for 5 cycles according to the foregoing operation to thereby form an organics/metal oxide composite thin film, and such composite thin film was then treated by oxygen plasma with oxygen partial pressure of 176 mTorr and RF power of 10 W at room temperature for 10 minutes. The sample was further covered on the surface thereof with a platinum layer of 2 nm thick in order to prevent charge-up, and then observed at electron acceleration voltage of 25 kV. Result was shown in FIG. 4. As shown in FIG. 4, the amorphous metal oxide thin film was found to be uniformly formed on the substrate.

To further confirm that a low-density amorphous metal oxide thin film can be formed in this Example, uptake of organic molecules into such amorphous metal oxide thin film was evaluated based on changes in the frequency of a quartz crystal microbalance resonator. First, the resonator was alternately adsorbed with titanium butoxide and PAA for 15 cycles as described in the above to thereby form the organics/metal oxide composite thin film, and the composite thin film was then treated by oxygen plasma under oxygen partial pressure of 176 mTorr and RF power of 10 W at room temperature for 20 minutes. Oxygen plasma treatment was further carried out with oxygen partial pressure of 176 mTorr and RF power of 20 W at room temperature for 40 minutes. The quartz crystal microbalance resonator was then dipped in 12 ml of acetonitrile which was further added with 60 μl of 50 mM 4-phenylazobenzoic acid solution in tetrahydrofuran after the frequency of the quartz crystal microbalance resonator became stable. Changes in the frequency of the quartz crystal microbalance resonator before and after the addition of 4-phenylazobenzoic acid were monitored in acetonitrile. Result is shown in FIG. 5.

Figure 5:
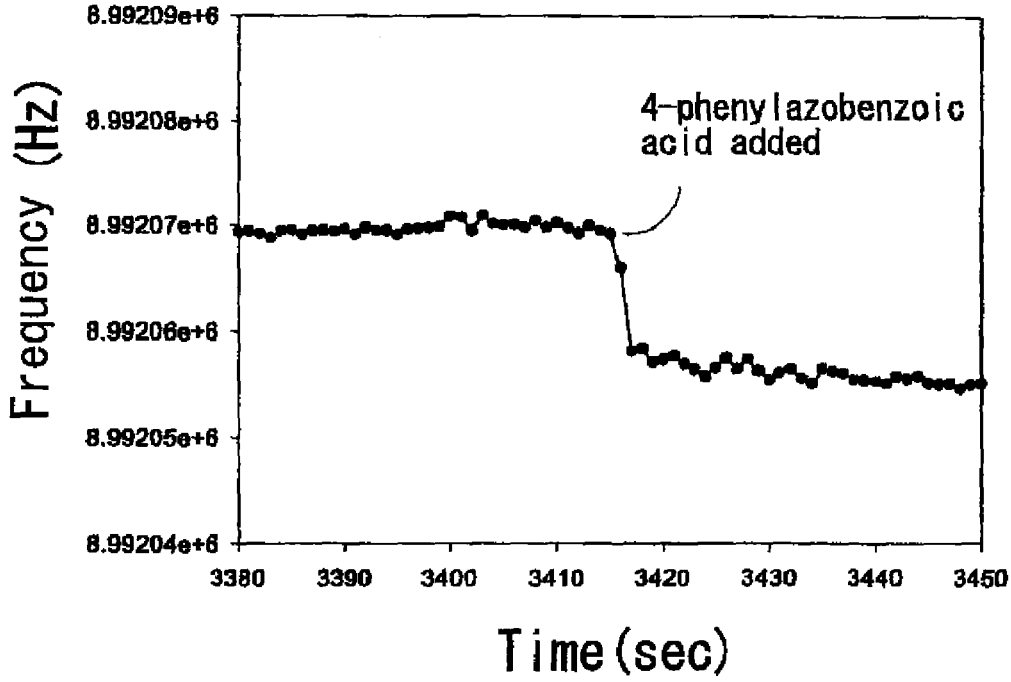
FIG. 5 is a graph showing in-situ changes in the frequency of a quartz crystal microbalance resonator by adsorption of 4-phenylazobenzoic acid into the amorphous metal oxide thin film of Example 1.
Figure 6:
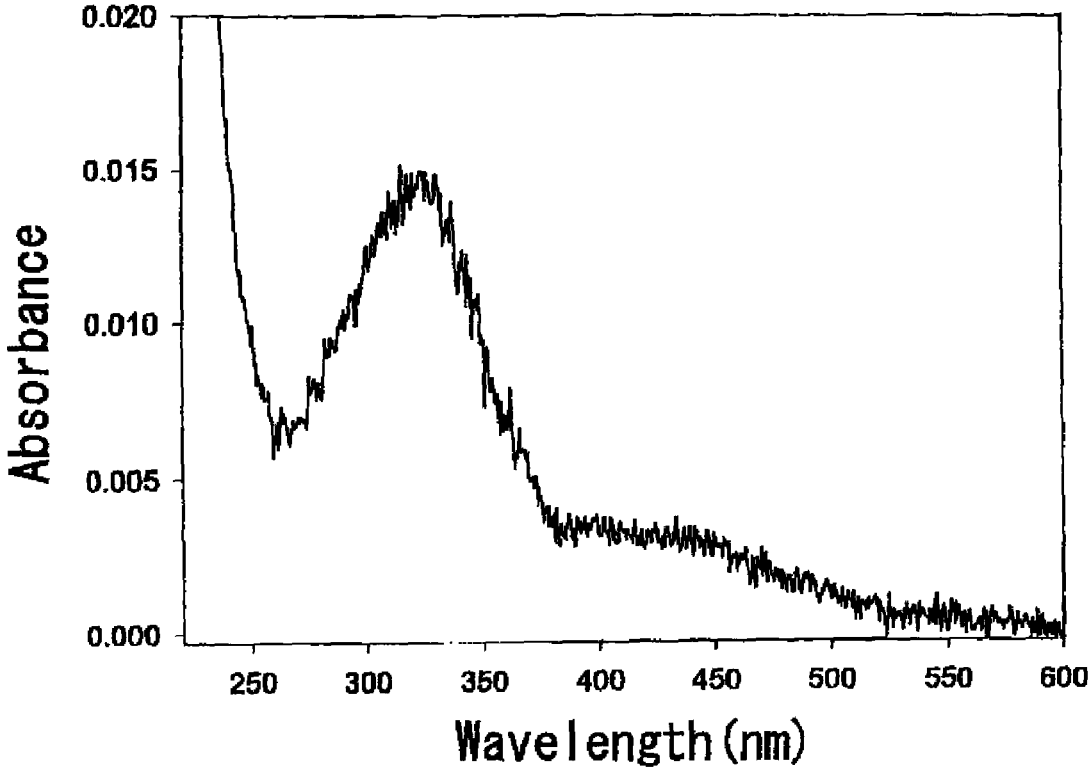
FIG. 6 is a UV-visible absorption spectrum of a solution of 4-phenylazobenzoic acid desorbed from the amorphous metal oxide thin film of Example 1 having previously adsorbed thereon such 4-phenylazobenzoic acid.

As is evident from FIG. 5, the addition of 4-phenylazobenzoic acid resulted in decrease in the frequency by approx. 10 Hz. The result indicates that the amorphous metal oxide thin film produced in this Example has quartz crystal microbalance resonator. The frequency of the quartz crystal microbalance resonator in solution does not always correspond to that measured in air, so that it is not appropriate to estimate the amount of absorption of 4-phenylazobenzoic acid based on such 10-Hz decrease in the frequency. The amount of intake was therefore assessed based on UV-visible absorption spectrum measurement described in the next. The foregoing quartz crystal microbalance resonator having formed thereon the amorphous metal oxide thin film incorporating 4-phenylazobanzoic acid was successively washed with acetonitrile and ion-exchanged water and then dipped in 3.0 ml of 1 wt % aqueous ammonia solution at 25° C. for 30 minutes, and the resultant solution was subjected to UV-visible absorption spectrometry measurement. Result is shown in FIG. 6. In FIG. 6, a peak having the absorption maximum at around 325 nm is ascribable to 4-phenylazobenzoic acid, which proves that 4-phenylazobenzoic acid had been incorporated within the amorphous metal oxide thin film produced according to the method of this Example. The amount of adsorption of 4-phenylazobenzoic acid was estimated as $1.82\times10^{-9}$ mol based on the absorbancy at 325 nm. This value is equivalent to 1.56 times of PAA removed by the oxygen plasma treatment on the mass basis, and corresponds to 0.5 times of the amount of carboxyl group of PAA on the molar basis.

To further obtain information on relations between the time duration of the oxygen plasma treatment and the amount of removal of the organic component in the production of the amorphous metal oxide thin film according to the method of this Example, and between the thickness of the organics/metal oxide composite thin film and the amount of removal of the organic component by the oxygen plasma treatment, the inventors prepared the organics/metal composite thin films on quartz crystal microbalance resonator while varying the thickness thereof, and then evaluated the amount of removal of the organic component in relation to the oxygen plasma treatment time based on changes in the frequencies. The samples employed herein were prepared according to the method of this Example, by which the quartz crystal microbalance resonators were alternately adsorbed with titanium butoxide and PAA for 15 cycles and for 20 cycles to thereby form the organics/metal oxide composite thin films. These composite thin films were treated by oxygen plasma with oxygen partial pressure of 176 mTorr and RF power of 10 W at room temperature for 10 minutes, additionally treated twice with oxygen partial pressure of 176 mTorr and RF power of 20 W at room temperature for 20 minutes. The frequency of the quartz crystal microbalance resonator was measured after every oxygen plasma treatment. Results were shown in Table 1.

TABLE 1

| | 15-Cycle film | 20-Cycle film |
|---|---|---|
| Changes in the frequency of the quartz crystal microbalance resonator caused by formation of the organic/metal oxide composite thin film | 705.1 Hz | 961.5 Hz |
| Changes in the frequency caused by growth of metal oxide in the organics/metal oxide composite thin film | 412.5 Hz | 510.4 Hz |
| Changes in the frequency caused by adsorption of PAA in the organics/metal oxide composite thin film | 292.6 Hz | 451.1 Hz |
| Treated with 10 W for 10 min. | 260.2 Hz | 297.1 Hz |
| Additionally treated with 10 W for 10 min. | 279.3 Hz | 301.8 Hz |
| Additionally treated with 20 W for 20 min. | 296.3 Hz | 299.7 Hz |
| Additionally treated with 20 W for 20 min. | 299.5 Hz | 296.4 Hz |

As shown in Table 1, the 15-cycle-adsorption film and 20-cycle-adsorption film significantly differed from each other in the final amount of PAA remained in the films after removal of the organic component by the oxygen plasma treatment. This indicates that the upper limit of the thickness allowing the removal of the organic component is 10 nm or around. Of course, the thickness allowing the removal of the organic component may vary depending on the composition of the organics/metal oxide composite thin film, temperature and so forth. It is, however, recommendable that the organics/metal oxide composite thin film produced in this Example is as thick as 20 nm or less. As is also clear from Table 1, almost entire portion of the organic component can be removed from the organics/metal oxide composite thin film produced by this Example when oxygen plasma treatment is carried out with oxygen partial pressure of 176 mTorr and RF power of 10 W at room temperature for 10 minutes.

Example 2

An organics/metal oxide composite thin film was produced according to method B in Example 2.

A 2:1 (v/v) mixed solvent of toluene and methanol was used to prepare 10 ml of a mixed solution containing titanium butoxide ($Ti(O^nBu)_4$) in 100 mM concentration and 4-phenylazobenzoic acid in 25 mM concentration. The mixed solution was stirred at room temperature for 16 hours, added with 50 μl of water, further stirred at room temperature for 4 hours, and diluted 20 times with toluene.

A quartz crystal microbalance resonator was dipped in thus obtained solution at 25° C. for 1 minute, successively dipped in toluene at 25° C. for 1 minute, blown with nitrogen gas to thereby dry it, and allowed to stand in the atmosphere while measuring the frequency of the quartz resonator. The frequency of the quartz resonator did not stabilize during a period of time that the alkoxide groups on the resonator substrate surface are being hydrolyzed, but became stable after several tens of minutes. Such adsorption, washing, drying and hydrolysis were repeated ten times to thereby form the organics/metal oxide composite thin film. Next, the quartz crystal microbalance resonator having on the surface thereof the organics/metal oxide composite thin film was then placed in the sample chamber of an oxygen plasma generation apparatus, and treated by oxygen plasma with oxygen partial pressure of 176 mTorr and an RF power of 10 W at room temperature for 10 minutes.

Figure 7:
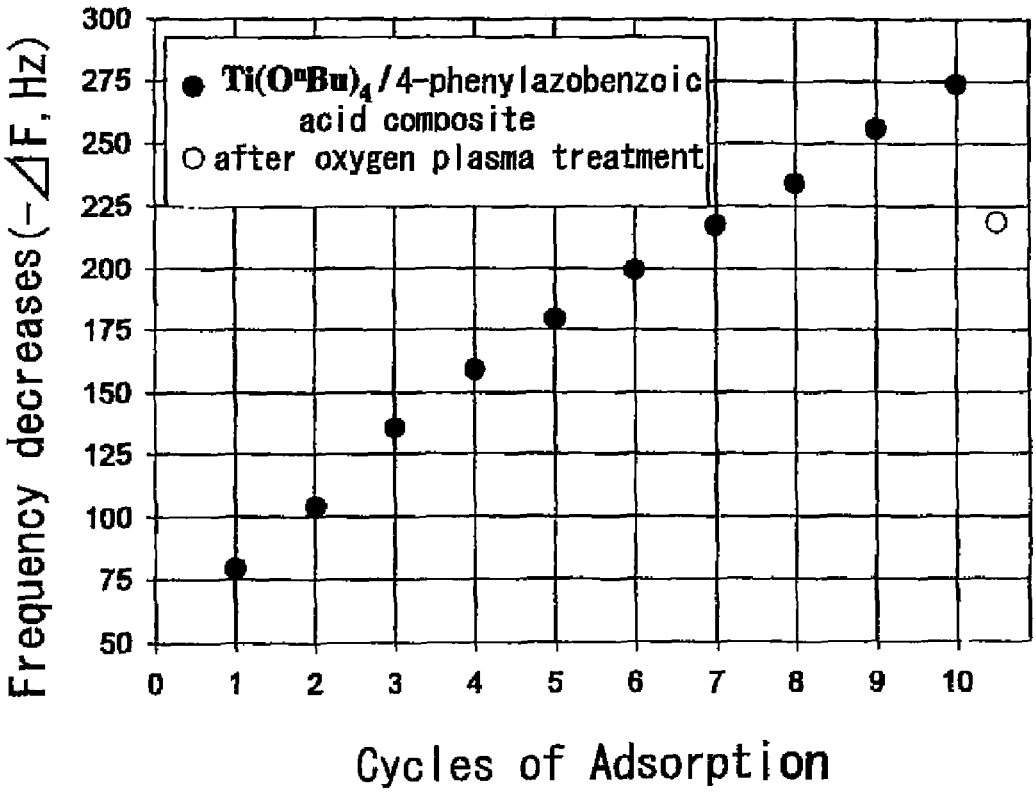
FIG. 7 is a graph showing changes in the frequency of a quartz crystal microbalance caused by stacking of the organics/metal oxide composite thin film and by oxygen plasma treatment.

FIG. 7 shows a graph displacing changes in the frequency of the quartz crystal microbalance resonator caused by stacking of the organics/metal oxide composite thin film and by oxygen plasma treatment, where ($-\Delta F$) represents decrease in the frequency from that for the quartz resonator before the organics/metal oxide composite thin film is formed thereon.

As is known from FIG. 7, the frequency decreased in proportion to the number of stacking of the organics/metal oxide composite thin films. This result indicates that the organics/metal oxide composite thin films of constant mass are successively formed on the surface of the electrode of the quartz crystal microbalance resonator. The total decrease in the frequency ($-\Delta F$) after ten times of the stacking was found to be 273.6 Hz. The oxygen plasma treatment increased the frequency of the quartz resonator by 52.3 Hz. The result indicates that the organic component was successfully removed by the oxygen plasma treatment.

UV-visible absorption spectrometry was then carried out to further prove that the organics/metal oxide composite thin film is successfully removed with the organic component by the oxygen plasma treatment so as to leave the amorphous metal oxide thin film on the substrate surface according to the method of this Example. A test sample was prepared using a quartz plate, on the surface of which the foregoing stacking was repeated ten times to thereby form the organics/metal oxide composite thin film. The sample was then treated by oxygen plasma with oxygen partial pressure of 176 mTorr and RF power of 10 W at room temperature for 10 minutes. UV-visible absorption spectra obtained before and after the treatment are shown in FIG. 8.

Figure 8:
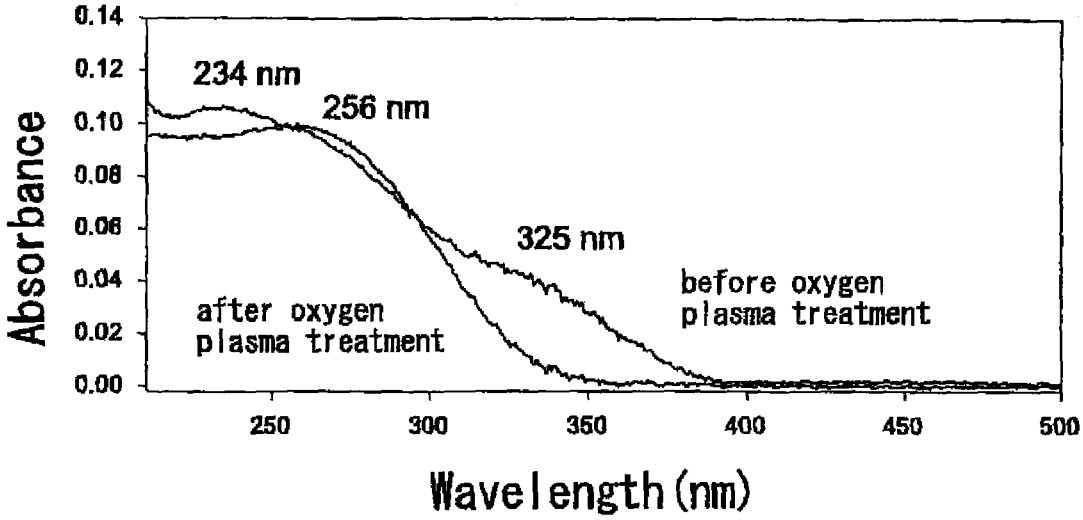
FIG. 8 is a UV-visible absorption spectral change of the organics/metal oxide composite thin film of Example 2 before and after the oxygen plasma treatment.

As shown in FIG. 8, the sample before oxygen plasma treatment gave a spectrum in which absorption bands specific to 4-phenylazobenzoic acid are observed at around 234 nm and 325 nm. On the other hand, the sample after oxygen plasma treatment gave a spectrum in which the absorption at around 234 nm is weakened and the absorption at around 325 nm almost disappeared. This indicates that the oxygen plasma treatment in this Example removed 4-phenylazobenzoic acid which is the organic component of the organics/metal oxide composite thin film. On the other hand, the sample after oxygen plasma treatment gave a spectrum in which the absorption threshold is observed at 330 nm, and the absorption maximum at 256 nm or around. This result indicates that the amorphous metal oxide thin film was formed on the substrate surface by the method of the this Example.

Example 3

A newly cleft mica plate was dipped in an aqueous solution containing polydiaryldimethyl in the concentration of 1 mg/ml at 25° C. for 2 minutes, and then in ion-exchanged water at 25° C. for 1 minute. The mica plate was further dipped in aqueous solution containing polystyrenesulfonic acid in the concentration of 1 mg/ml at 25° C. for 2 minutes, and successively in ion-exchanged water at 25° C. for 1 minute. The mica plate was still further dipped in the foregoing aqueous polydiaryldimethyl solution at 25° C. for 2 minutes, and successively in ion-exchanged water at 25° C. for 1 minute to thereby produce on such mica plate a polymer ultra-thin film having the surface charged in positive. The resultant plate was then dipped in 0.27 wt % aqueous dispersion of polystyrene particles having carboxyl groups on the surface thereof (500 nm in diameter, commercial product) at room temperature for 10 minutes, to thereby allow such polystyrene particles to adsorb onto the surface of the plate.

The plate was then dipped in titanium isopropoxide ethanol solution in the concentration of 100 mM at room temperature for 10 minutes, successively dipped in ethanol for 1 minute, and then dipped in ion-exchanged water for 1 minute to thereby hydrolyze titanium isopropoxide that chemically adsorbed on the surface thereof. The plate was blown with nitrogen gas for drying. The plate was then dipped in PAA aqueous solution in the concentration of 1 mg/ml for 2 minutes, washed by dipping it in ion-exchanged water for 1 minute, and then blown with nitrogen gas for drying. Such adsorption of titanium isopropoxide, washing with ethanol, hydrolysis with ion-exchanged water, drying with nitrogen gas, adsorption of PAA, and drying with nitrogen gas were repeated 5 times. The plate was then dipped in an ethanol solution containing titanium isopropoxide in the concentration of 100 mM for 2 minutes, washed by dipping in ethanol for 1 minute, and then dipped in ion-exchanged water for 1 minute to thereby hydrolyze titanium isopropoxide that chemically adsorbed on the surface thereof. The plate was further blown with nitrogen gas for drying.

Figure 9:
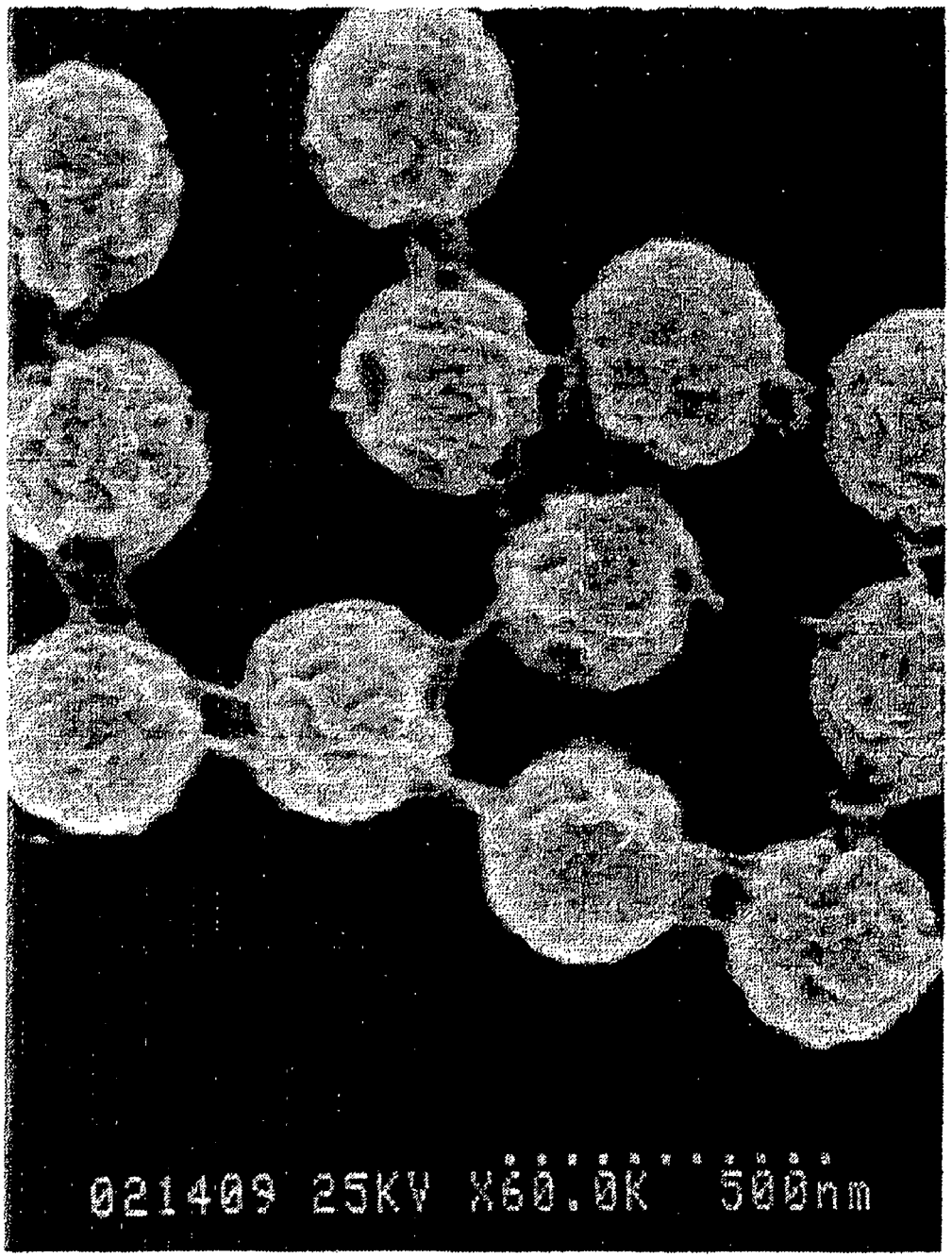
FIG. 9 is an image of the surface of the amorphous metal oxide thin film of Example 3 observed with a scanning electron microscope.

Next, the plate was subjected to oxygen plasma treatment with oxygen partial pressure of 180 mTorr and an RF power of 20 W at room temperature for 1 hour. The plate was then covered on the surface thereof with a platinum layer of 2 nm thick, and observed with scanning electron microscope at an electron acceleration voltage of 25 kV. The observed image is shown in FIG. 9. As shown in FIG. 9, the observed thin film was found to comprise grains of approx. 300 nm in diameter that crosslinked with each other via string-like structure of approx. 10 to 50 nm wide, and the coverage ratio thereof relative to the plate was approx. 60%. Observation in detail of the inner structure of the thin film further revealed that the grain portion has a hollow structure. Since such hollow structure was not observed before the oxygen plasma treatment, it was demonstrated that the technique of this Example is successful in producing the thin film material comprising hollow amorphous metal oxide grains.

Example 4

A newly-cleft mica plate was dipped in polydiaryldimethyl aqueous solution in the concentration of 1 mg/ml at 25° C. for 2 minutes, and then in ion-exchanged water at 25° C. for 1 minute. The mica plate was then dipped in polystyrenesulfonic acid aqueous solution in the concentration of 1 mg/ml at 25° C. for 2 minutes, and successively in ion-exchanged water at 25° C. for 1 minute. The mica plate was further dipped in the foregoing aqueous polydiaryldimethyl solution at 25° C. for 2 minutes, and successively in ion-exchanged water at 25° C. for 1 minute to thereby produce on such mica plate a polymer ultra-thin film having the surface charged in positive. The resultant plate was then dipped in 0.5 wt % aqueous dispersion of polystyrene particles having carboxyl groups on the surface thereof (500 nm in diameter, commercial product) at room temperature for 2 minutes, to thereby allow such polystyrene particles to adsorb onto the surface of the plate. The plate was then dipped in titanium isopropoxide ethanol solution in the concentration of 100 mM for 2 minutes, successively washed by dipping it in ethanol for 1 minute, and then dipped in ion-exchanged water for 1 minute to thereby hydrolyze titanium isopropoxide that chemically adsorbed on the surface thereof. Such adsorption of titanium isopropoxide, washing with ethanol and hydrolysis were repeated ten times, and the resultant plate was blown with nitrogen gas for thorough drying. The plate was then treated by oxygen plasma with oxygen partial pressure of 180 mTorr and RF power of 20 W at room temperature for 1 hour. The plate was further covered on the surface thereof with a platinum layer of 2 nm thick, and then observed with scanning electron microscope at electron acceleration voltage of 25 kV. The image obtained is shown in FIG. 10.

Figure 10:
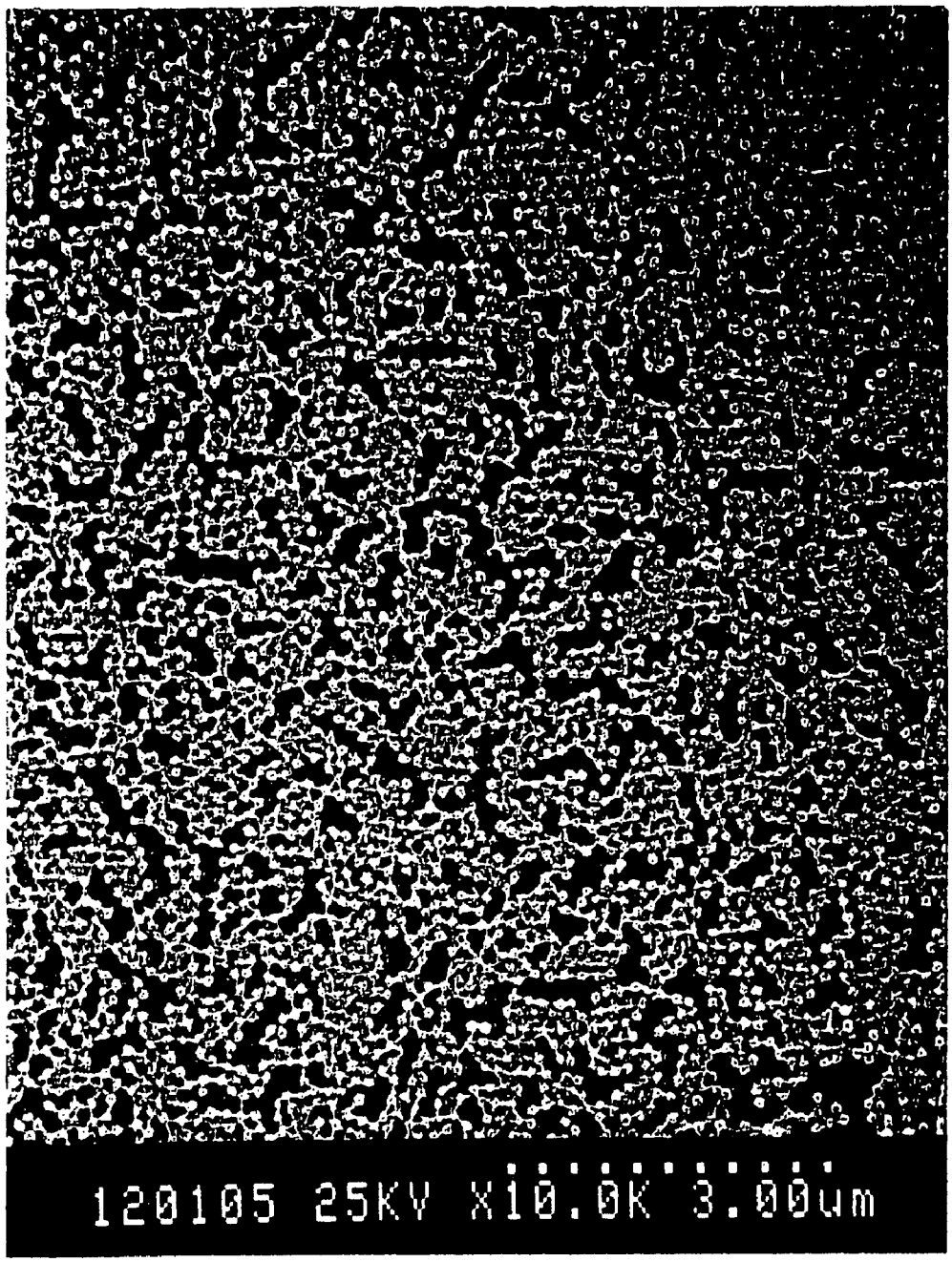
FIG. 10 is an image of the surface of the amorphous metal oxide thin film of Example 4 observed with a scanning electron microscope.

As shown in FIG. 10, the observed thin film was found to comprise grains of approx. 250 nm in diameter that crosslinked with each other via string-like structure of approx. 10 to 50 nm wide, and the coverage ratio thereof relative to the plate was approx. 90%. Observation in detail of the inner structure of the thin film further revealed that the grain portion has a hollow structure. Since such hollow structure was not observed before oxygen plasma treatment, it was demonstrated that the technique of this Example is successful in producing the thin film material comprising hollow amorphous metal oxide grains.

Example 5

Now in Example 5, an organics/metal oxide composite thin film was produced using a plurality of metal alkoxide compounds according to method A. This Example is to demonstrate that the method of the present invention is successful in forming the amorphous composite metal oxide thin film.

Zirconium butoxide ($Zr(O^nBu)_4$) was dissolved in 1:1 (v/v) mixed solvent of toluene and ethanol so as to attain the concentration of 20 mM, the foregoing quartz crystal microbalance resonator was dipped in the obtained solution at 25° C. for 1 minute, washed by dipping the quartz resonator in ethanol at 25° C. for 1 minute, dipped in ion-exchanged water at 25° C. for 1 minute to thereby form thereon a metal oxide thin film, and blown with nitrogen gas for drying. After the frequency of such quartz crystal microbalance resonator was measured, the quartz resonator was dipped in PAA ethanol in the solution concentration of 1 mg/ml for 10 minutes, washed by dipping into ethanol at 25° C. for 1 minute, and blown with nitrogen gas for drying. The frequency of the quartz crystal microbalance resonator was measured again. Such thin film forming processes were repeated seven times to thereby form the organics/metal oxide composite thin film.

On the other hand, titanium butoxide ($Ti(O^nBu)_4$) was dissolved in 1:1 (v/v) mixed solvent of toluene and ethanol so as to attain the concentration of 100 mM, the foregoing quartz crystal microbalance resonator having formed on the surface thereof the organics/metal oxide composite thin film was dipped in the obtained solution at 25° C. for 3 minutes, washed by dipping the resonator in ethanol at 25° C. for 1 minute, dipped in an ion-exchanged water at 25° C. for 1 minute to thereby form thereon a metal oxide thin film, and blown with nitrogen gas for drying. After the frequency of such resonator was measured, the resonator was dipped in PAA ethanol solution in the concentration of 1 mg/ml for 10 minutes, washed by dipping into ethanol at 25° C. for 1 minute, and blown with nitrogen gas for drying. The frequency of the quartz crystal microbalance resonator was measured again. Such thin film forming processes were repeated seven times to thereby form the organics/metal oxide composite thin film.

The quartz crystal microbalance resonator having formed on the surface thereof the organics/metal oxide composite thin film which comprises PAA/zirconia layer and PAA/titania layer was then placed in the sample chamber of an oxygen plasma generation apparatus, and treated by oxygen plasma with oxygen partial pressure of 176 mTorr and RF power of 10 W at room temperature for 10 minutes.

Figure 11:
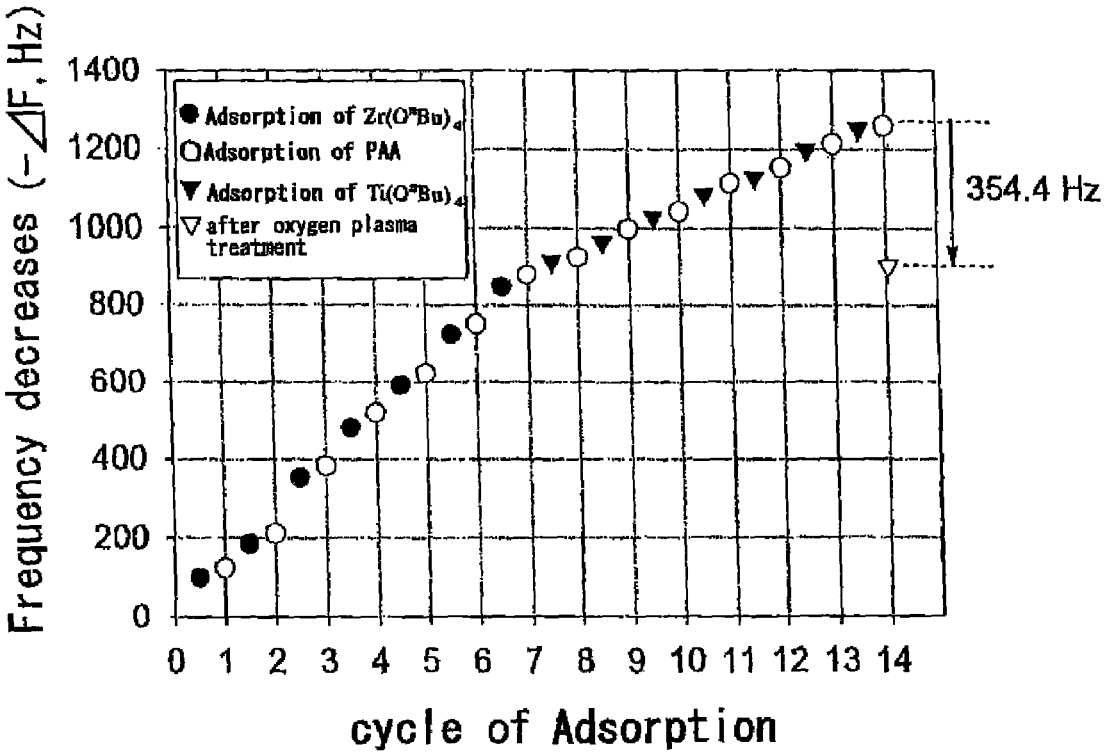
FIG. 11 is a graph showing changes in the frequency of a quartz crystal microbalance resonator caused by stacking and oxygen plasma treatment of the organics/metal oxide composite thin film of Example 5.

FIG. 11 is a graph showing changes in the frequency of the quartz crystal microbalance resonator caused by stacking of the organics/metal oxide composite thin films and by oxygen plasma treatment, where ($-\Delta F$) represents decrease in the frequency from that for the resonator before the organics/metal oxide composite thin film is formed thereon.

As is known from FIG. 11, the frequency decreased in proportion to the number of stacking of the organics/metal oxide composite thin films. This result indicates that the organics/metal oxide composite thin films having a constant mass were successively formed on the surface of the electrode of the quartz crystal microbalance. Increase in the film thickness in each cycle of the composite thin film composed of zirconium butoxide and PAA was thus calculated as 21 Å, and that of the composite thin film composed of titanium butoxide and PAA was thus calculated as 9 Å. Total decrease in the frequency caused by the adsorption of PAA was estimated as 341.1 Hz. Oxygen plasma treatment resulted in increase in the frequency by 354.4 Hz. This value is almost equivalent to the total decrease in the frequency caused by the adsorption of PAA, which indicates that the oxygen plasma treatment in the present Example completely removed the organic component.

Figure 12:
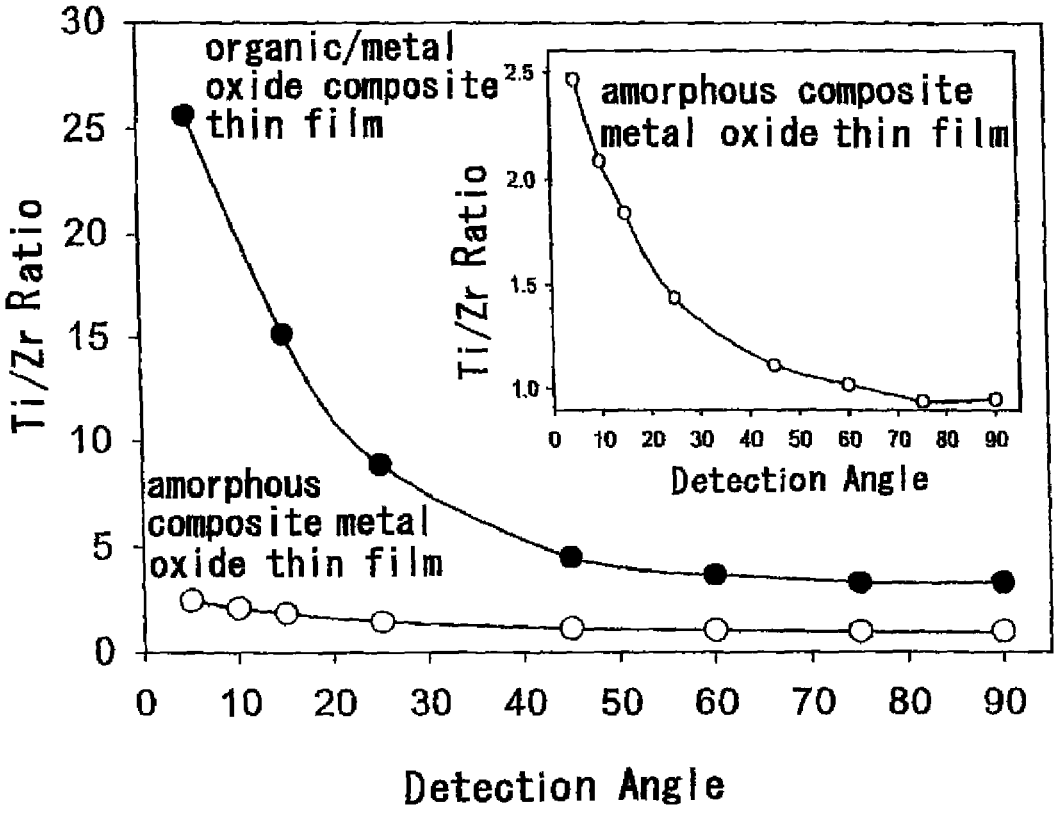
FIG. 12 is a graph showing detection angle dependence of the compositional ratios of titanium atom and zirconium atom in the organics/metal oxide composite thin film of Example 5 and amorphous composite metal oxide film formed after the oxygen plasma treatment, which ratios being estimated from XPS spectra; where marks ● and ○ represent the compositional ratios for the organics/metal oxide composite thin film and amorphous composite metal oxide thin film, respectively; and where an inserted graph is an enlarged view of the values for the amorphous composite metal oxide thin film.

To demonstrate that the amorphous metal oxide composite thin film produced according to the method of this Example has a titania layer on the outermost surface and zirconia layer thereunder, angle dependence in XPS spectroscopy was investigated. Samples employed herein were prepared using quartz substrates, on the surface of which zirconium butoxide and PAA were adsorbed for 7 cycles, and then titanium butoxide and PAA were adsorbed for 7 cycles to thereby form an organics/metal oxide composite thin film, and some of such samples were further treated by oxygen plasma with oxygen partial pressure of 176 mTorr and RF power of 10 W at room temperature for 10 minutes. XPS spectra were measured at detection angles between 5° to 90°, where the detection angle was defined as 90° when a detector was placed normal to the surface of the sample, and as 0° when placed in parallel thereto. Detection angle dependence of atomic ratio of titanium and zirconium estimated from the XPS spectra is shown in FIG. 12, where symbols "●" and "○" represent Ti/Zr compositional ratios for the organics/metal oxide composite thin film and amorphous composite metal oxide thin film, respectively. The inserted graph is an enlarged expression of the values for the amorphous composite metal oxide thin film.

As is clear from FIG. 12, the organics/metal oxide composite thin film showed larger atomic ratio of titanium at smaller detection angle, which proved abundance of titanium atoms in the surface layer, and showed larger atomic ratio of zirconium in relation to titanium at larger detection angle, which proved increased content of zirconium atoms in the area deep from the surface. The film after oxygen plasma treatment also showed abundance of titanium atoms in the surface layer, and increase in zirconium content in the deep area, although the detection angle dependence decreased. Such decrease in the detection angle dependence is attributable to that the detection depth increased by virtue of the removal of the organic component, or another possibility resides in that the titania layer and zirconia layer are partially fused with each other to thereby form a nano-gradient structure. Any way the detection of zirconium and titanium atoms in the XPS spectra clearly show that the method of this Example is successful in obtaining the thin film material of composite metal oxide.

Figure 13:
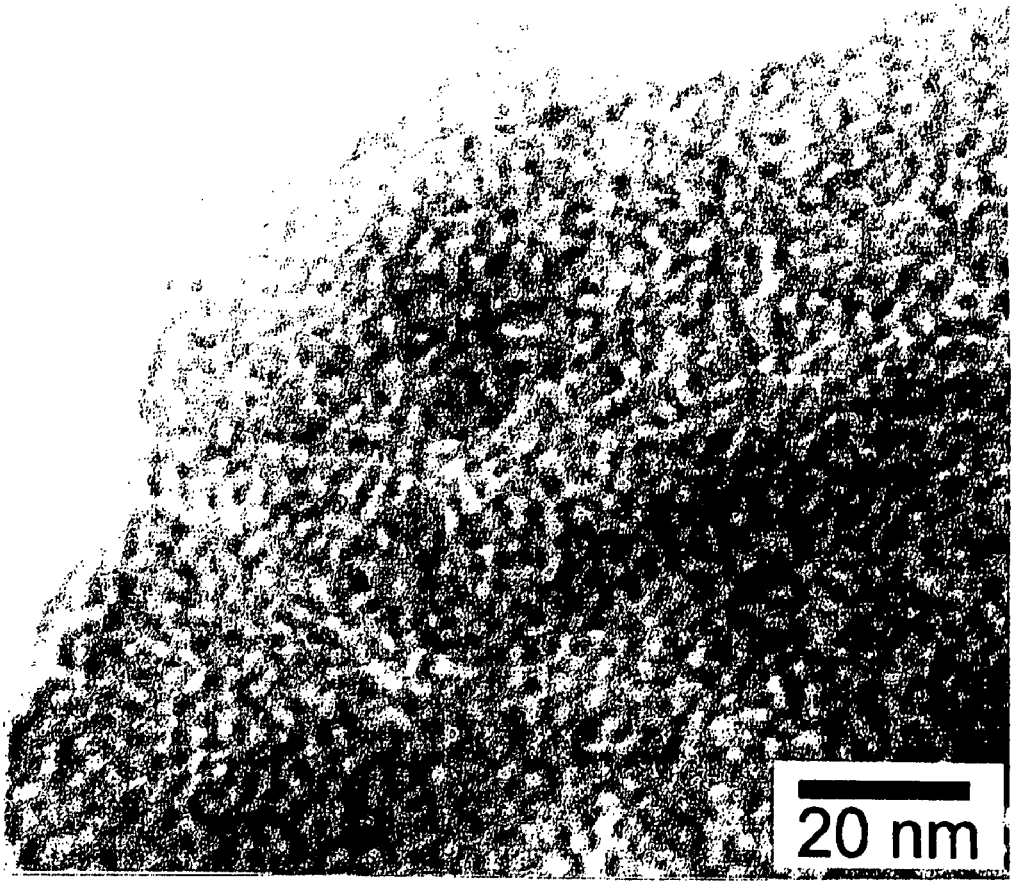
FIG. 13 is an image of the amorphous metal oxide composite thin film of Example 5 observed with a transmission electron microscope.

To further demonstrate that the porous thin film material of amorphous composite metal oxide can be obtained by the method of this Example, the thin film material was observed with transmission electron microscope. A sample employed herein was prepared using a quartz substrate, on the surface of which zirconium butoxide and PAA were adsorbed for 7 cycles, and then titanium butoxide and PAA were adsorbed for 7 cycles to thereby form an organic/metal oxide composite thin film, and ten treated by oxygen plasma with oxygen partial pressure of 176 mTorr and RF power of 10 W at room temperature for 10 minutes. The obtained thin film material was chipped and fixed on a carbon-coated copper grid. An obtained image is shown in FIG. 13. FIG. 13 clearly shows that the amorphous composite metal oxide thin film produced by the method of this Example has uniformly distributed therein voids of approx. 2 nm in diameter.

The present invention thus can provide an amorphous metal oxide thin film having an excellent thickness accuracy at nanometer level. The present invention can also provide an amorphous metal oxide thin film having a wide variety of composition or texture, where control of the density thereof also possible. The present invention can still also produce the amorphous metal oxide thin film in an exact manner on the surface having every kind of morphology or on the substrate having a large area under a mild condition based on the adsorption from solution by simple procedures.

The amorphous metal oxide thin film having thus properly-controlled composition or density is advantageous in controlling physicochemical properties or electronic properties unlike those of conventional thin film. The low-density oxide thin film can provide a thin film having novel properties which could not be attained by the conventional CVD process or ion beam sputtering. So that such thin film material of the present invention is fully expected for use as that having an extra-low dielectric constant or for production of various sensors, and is particularly promising as an insulating material for circuits patterned in a design rule of 10 to 20 nm or having irregular surface profile, or as a masking or coating material used for ultra-fine processing on solid surface.

The low-density amorphous metal oxide thin film produced according to the present invention has a vast number of voids having nanometer size. So that it may be available also in novel material synthesis based on its ability of immobilizing catalysts or incorporating ions. The film may be also promising in applications as a photo-catalyst or a material having a super-hydrophilic surface since the film surface can have chemical, mechanical or optical properties not found before.

Moreover, the low-density amorphous metal oxide thin film produced by the method of the present invention will successfully improved in the mechanical strength when formed on a porous material having large voids. So that the obtained material can be used as a molecular sieve which allows selective permeation of specific solution or gas. Such thin film formed on the support will be available as a separation material, and such selective permeation will add value of the film as a compositional element of fuel cell.

What is claimed is:

1. A method of preparing a thin film material of an amorphous metal oxide having a density of 0.8 to 2.5 g/cm$^3$, and a thickness of 0.5 to 50 nm, comprising the steps of:

(1) adsorbing substrates onto a surface of a plate;

(2) bringing a compound having a metal alkoxide group into contact with said substrates to thereby allow said compound having a metal alkoxide group to chemically adsorb on a surface of said substrates;

(3) removing through rinsing any portion of said compound having a metal alkoxide group which was not adsorbed on the surface of said substrates;

(4) hydrolyzing said compound having a metal alkoxide group to thereby form a metal oxide thin film;

(5) allowing the metal oxide thin film to contact with an adsorption-active organic compound capable of chemically adsorbing onto said metal oxide thin film and of forming reactive groups having reactivity with the metal alkoxide group of said compound having a metal alkoxide group, so the metal oxide thin film on said substrates adsorbs the adsorption-active organic compound;

(6) removing any portion of said organic compound not adsorbed in step (5) to thereby form an organic compound thin film;

(7) repeating steps (2)-(6) at least once to obtain an organics-metal oxide composite thin film; and (8) removing an organic component from said organics-metal oxide composite thin film by an oxygen plasma treatment to form said thin film material of an amorphous metal oxide, wherein the substrates are organic particles, and the organic particles are removed by said oxygen plasma treatment to form the thin film material, and wherein said thin film material includes hollow amorphous metal oxide grains that are crosslinked with each other.

2. The method as claimed in claim 1, wherein the thin film of amorphous metal oxide is formed on said substrates and the substrates have on the surface thereof reactive groups having reactivity to metal alkoxide group, and the thin film material of amorphous metal oxide is bound to the substrates through some or all of the reactive groups.

3. The method as claimed in claim 1, wherein the step of forming the metal oxide thin film in step (4) and the step of forming the organic compound thin film in step (6) are repeated more than once.

4. The method as claimed in claim 1, wherein the reactive group having reactivity to the metal alkoxide group or the group capable of binding with metal alkoxide group is a hydroxyl group or a carboxyl group.

5. A method of preparing a thin film material of an amorphous metal oxide comprising: (1) adsorbing substrates onto a surface of a plate; (2) forming an organics-metal alkoxide composite comprising a compound having a metal alkoxide group, and an organic compound having a hydroxyl group or a group capable of binding with a metal alkoxide group; (3) bringing the organics-metal alkoxide composite into contact with said substrates to thereby chemically adsorb said composite on the surface of said substrates; (4) removing through rinsing any portion of said organics-metal alkoxide composite not adsorbed in step (3); hydrolyzing any organics-metal alkoxide composite remaining on the surface of the substrates to thereby form an organics-metal oxide composite thin film; and (5) removing an organic component from the organics-metal oxide composite thin film through oxygen plasma treatment, and repeating the process for forming another organics-metal oxide composite thin film at least once, wherein the substrates are organic particles, and the organic particles are removed by said oxygen plasma treatment to form the thin film material, and wherein said thin film material includes hollow amorphous metal oxide grains that are crosslinked with each other.

6. The method as claimed in claim 5, wherein the concentration of the organic component in the organics-metal oxide composite thin film is 15 to 85 wt %.

7. The method as claimed in claim 5, wherein the organic component within the organics-metal oxide composite has a thickness of 0.5 to 10 nm.

8. A method of preparing a thin film material of amorphous metal oxide comprising:

adsorbing substrates onto a surface of a plate;

forming, through chemical adsorption and rinsing, on a surface of said substrates, an organics-metal oxide composite thin film having dispersed therein an organic component, wherein a thickness of the organic component in the organics-metal oxide composite thin film is not greater than 10 nm, and an expansion range of the organic component is not greater than 100 nm, and then removing the organic component through oxygen plasma treatment to thereby produce the thin film material of amorphous metal oxide, wherein the substrates are organic particles, and the organic particles are removed by said oxygen plasma treatment to form the thin film material, and wherein said thin film material includes hollow amorphous metal oxide grains that are crosslinked with each other.

9. The method as claimed in claim 8, further comprising chemically absorbing a compound having a metal alkoxide group on a surface of the substrates; removing through rinsing any portion of said compound having a metal alkoxide group not adsorbed on a surface of the substrates; hydrolyzing any compound having a metal alkoxide group remaining on the surface of the substrates to thereby form a metal oxide thin film; optionally repeating the process for forming another metal oxide thin film on the previously-formed metal oxide thin film at least one or more number of times; allowing the outermost metal oxide thin film to contact with an adsorption-active organic compound having an adsorptive property, and being capable of chemically adsorbing onto said metal oxide thin film and of forming reactive groups having reactivity with the metal alkoxide group to adsorb the adsorption-active organic compound on said substrates; removing any portion of said organic compound not adsorbed to thereby form an organic component thin film; optionally repeating the process for forming another metal oxide thin film on the previously-formed organic compound thin film at least one or more number of times; wherein the metal oxide thin film(s) and the organic component thin film(s) form the organics-metal oxide composite thin film; and removing the organic component through oxygen plasma treatment.

10. The method as claimed in claim 8, further comprising chemically absorbing a metal alkoxide group on a surface of the substrates; removing through rinsing any portion of said compound having a metal alkoxide group not adsorbed on a surface of the substrates; hydrolyzing any compound having a metal alkoxide group remaining on the surface of the substrates to thereby form a metal oxide thin film; optionally repeating the process for forming another metal oxide thin film on the previously-formed metal oxide thin film at least one or more number of times; allowing the outermost metal oxide thin film to contact with an adsorption-active organic compound having an adsorptive property, and being capable of chemically adsorbing onto said metal oxide thin film and of forming reactive groups having reactivity with the metal alkoxide group so as to adsorb the adsorption-active organic compound on said substrates; removing any portion of said organic compound not adsorbed to thereby form an organic component thin film; repeating the process for forming said metal oxide thin film and said organic compound thin film at least one or more number of times; optionally repeating the process for forming another metal oxide thin film on the previously-formed organic compound thin film at least one or more number of times; wherein the metal oxide thin film(s) and the organic component thin film(s) form the organics-metal oxide composite thin film; and removing the organic component through oxygen plasma treatment.

11. The method as claimed in claim 10, wherein a plurality of metal oxide thin films are formed, and wherein a metal oxide resent in at least one of the plurality of metal oxide thin films is different from a metal oxide present in other metal oxide thin films.

12. The method as claimed in claim 8, further comprising bringing the organics-metal alkoxide composite into contact with the substrates to thereby cause said composite to chemically adsorb on the surface of said substrates; removing through rinsing any portion of said organics-metal alkoxide composite not adsorbed; hydrolyzing any organics-metal alkoxide composite remaining on the surface of the substrates to thereby form an organics-metal oxide composite thin film; optionally repeating the process for forming another organics-metal oxide composite thin film at least one or more number of times; and removing the organic component through the oxygen plasma treatment.

13. The method as claimed in claim 9, wherein the reactive group having reactivity to the metal alkoxide group or the group capable of binding with metal alkoxide group is a hydroxyl group or carboxyl group.

* * * * *